US008052584B2

(12) United States Patent
Keiser

(10) Patent No.: US 8,052,584 B2
(45) Date of Patent: Nov. 8, 2011

(54) SYSTEM AND METHOD FOR DETERMINING A RESISTANCE LEVEL FOR TRAINING A MUSCLE GROUP FOR MAXIMUM POWER GENERATION

(75) Inventor: Dennis L. Keiser, Sanger, CA (US)

(73) Assignee: Keiser Corporation, Fresno, CA (US)

( * ) Notice: Subject to any disclaimer, the term of this patent is extended or adjusted under 35 U.S.C. 154(b) by 1652 days.

(21) Appl. No.: 11/025,575

(22) Filed: Dec. 29, 2004

(65) Prior Publication Data

US 2005/0239615 A1 Oct. 27, 2005

Related U.S. Application Data

(60) Provisional application No. 60/564,369, filed on Apr. 22, 2004.

(51) Int. Cl.
*A63B 21/00* (2006.01)

(52) U.S. Cl. ..... 482/100; 482/137; 482/8; 482/142

(58) Field of Classification Search ..... 482/1–10, 482/100, 137, 133, 72
See application file for complete search history.

(56) References Cited

U.S. PATENT DOCUMENTS

| | | | |
|---|---|---|---|
| 3,848,467 | A | 11/1974 | Flavell |
| 4,050,310 | A | 9/1977 | Keiser |
| 4,257,593 | A | 3/1981 | Keiser |
| 4,601,468 | A | 7/1986 | Bond et al. |
| 4,730,829 | A | 3/1988 | Carlson |
| 4,805,455 | A | 2/1989 | DelGiorno et al. |
| 4,842,274 | A | 6/1989 | Oosthuizen et al. |
| 4,846,466 | A | 7/1989 | Stima |
| 4,905,676 | A | 3/1990 | Bond et al. |
| 4,907,797 | A | 3/1990 | Gezari et al. |
| 5,209,223 | A | 5/1993 | McGorry et al. |
| 5,336,145 | A | 8/1994 | Keiser |
| 5,526,692 | A | 6/1996 | Keiser |
| 5,722,937 | A | 3/1998 | Smith |

(Continued)

FOREIGN PATENT DOCUMENTS

DE 40 31 481 A1 4/1992

(Continued)

OTHER PUBLICATIONS

International Search Report for application No. PCT/US2005/013290 mailed on Apr. 19, 2005.

(Continued)

*Primary Examiner* — Jerome W Donnelly
(74) *Attorney, Agent, or Firm* — Knobbe Martens Olson & Bear LLP

(57) ABSTRACT

An apparatus and method evaluate the power of a muscle group of a user by measuring velocities of an engagement assembly coupled to a resistance element and moved by the user at a highest achievable velocity through a selected number of exercise strokes at each of two resistance levels. A first velocity is determined at a first resistance level. A second velocity is determined at a second resistance level. The first and second velocities are used in combination with the two resistance levels to determine a relationship between the velocity and the resistance level for a particular user. The resistance level where the resistance level and the velocity correspond to an overall maximum power is determined and is displayed for the user so that the user may use the optimum resistance level for training for maximum power generation.

13 Claims, 12 Drawing Sheets

U.S. PATENT DOCUMENTS

| | | | | |
|---|---|---|---|---|
| 5,997,440 | A | 12/1999 | Hanoun | |
| 6,027,429 | A | 2/2000 | Daniels | |
| 6,231,481 | B1 | 5/2001 | Brock | |
| 6,270,445 | B1 | 8/2001 | Dean et al. | |
| 6,503,173 | B2 * | 1/2003 | Clem | 482/8 |
| 6,672,157 | B2 | 1/2004 | MacFarlane et al. | |
| 2002/0025890 | A1 | 2/2002 | Keiser | |
| 2002/0086774 | A1 | 7/2002 | Warner | |
| 2003/0115955 | A1 | 6/2003 | Keiser | |

FOREIGN PATENT DOCUMENTS

| | | | |
|---|---|---|---|
| EP | 0 199 442 | | 10/1986 |
| EP | 0 275 959 | A2 | 7/1988 |
| EP | 1 208 876 | | 5/2002 |
| JP | 10085363 | | 4/1998 |
| WO | WO 86/06947 | | 12/1986 |
| WO | WO 03/041890 | A1 | 5/2003 |
| WO | WO 2005/000424 | | 1/2005 |

OTHER PUBLICATIONS

KEISER® Technical Information on A400 Software Version V3.15, Oct. 2, 1997, 4 pages.

*KEISER® Documentation on the use of the CAPTURE program*, Apr. 1999, 6 pages.

*KEISER® A400 Software Manual*, Version 4.01, Apr. 1999, pp. 1-11.

*Keiser A420 Operations and Maintenance Manual*, Rev A, Jun. 28, 2002, pp. 1-26.

*iButton Overview*, Maxim/Dallas Semiconductor Corporation, 2002, 3 pages.

*iButton Applications*, Maxim/Dallas Semiconductor Corporation, 2002, 2 pages.

*When is a pound not a pound? Keiser compares iron and air*, Keiser Corporation, Fresno, California, 2001, pp. 1-4.

*Strength Training and Aging*, Research Abstracts, Keiser Institute on Aging, 1999, pp. 1-67 and inside cover article.

*Keiser Chip System Operation Manual*, Keiser Corporation, pp. 1-7.

* cited by examiner

SYSTEM AND METHOD FOR DETERMINING A RESISTANCE LEVEL FOR TRAINING A MUSCLE GROUP FOR MAXIMUM POWER GENERATION

RELATED APPLICATIONS

The present application claims the benefit of priority under 35 U.S.C. §119(e) of U.S. Provisional Application No. 60/564,369, filed on Apr. 22, 2004, which is incorporated by reference herein.

BACKGROUND OF THE INVENTION

1. Field of the Invention

The present invention is applicable to the fields of fitness, exercise, physical rehabilitation, sports medicine and extremity testing and is directed to methods and apparatuses useable in such fields.

2. Description of the Related Art

Numerous devices have been developed to increase the strength, agility and quickness of athletes and other persons. In addition to enhancing the performance of athletes, such devices are used to improve or maintain the fitness and health of non-athletes, both to enhance the lifestyles of non-athletes and to potentially increase their respective life spans. Such devices range from basic equipment such as barbells, dumbbells, and the like, to increasingly more complex equipment such as universal gyms which enable a user to quickly modify the weights or resistances being used to exercise the user's muscles. See, for example, U.S. Pat. Nos. 4,257,593, 5,526,692 and 5,336,145 to Dennis L. Keiser and U.S. Patent Application Publication No. U.S. 2002/0024590 A1, which describe exercising apparatuses and related devices using pneumatic devices to provide controllable resistances, and which are incorporated by reference herein. In particular, such pneumatic exercising apparatuses advantageously reduce or eliminate the inertial effects of conventional weights wherein the force required to start moving a weight and the tendency of the weights to continue moving cause the forces required during each exercising stroke to vary throughout the stroke. Such pneumatic apparatuses provide a generally constant resistance throughout the exercising stroke.

In addition to being used for the development of strength, agility and quickness, exercising apparatuses can be used to measure strength, agility and quickness of a person. For example, a person's ability to lift weights against the force of gravity or a corresponding ability to move against a resistance can be measured at different times to determine whether such characteristics are improving in response to an exercise program or in response to therapy. Such measurements can also be used for evaluation purposes to determine whether one or more muscles or muscle groups are not performing adequately so that a therapist or a fitness trainer, for example, can develop a program of therapy or training more specifically directed to the inadequately performing muscles.

Historically, measurement and evaluation of muscular performance have concentrated on measuring the strength of a muscle or muscle group (e.g., measuring the amount of weight that can be lifted). However, it has been determined that strength alone does not accurately represent the performance of muscles. A person's muscles may be able to lift an adequate amount of weight, but may be too slow to be useful for many purposes. For example, an athlete putting the shot at a track and field contest must have the strength to easily move the sixteen-pound shot; however, the strength must be coupled with sufficient speed to cause the shot to be propelled with enough velocity to travel in excess of 70 feet (e.g., 70 feet, 11.25 inches by Randy Barnes at the 1996 Atlanta Olympics). In contrast, some activities require the ability to move very heavy objects at much lower velocities. Thus, although the power requirements may be similar for two activities, the forces and velocities at which the maximum power is required may be different for the two activities.

From the foregoing it should be understood that a more meaningful measurement of the performance of a person's muscles is a measurement of power (e.g., a measurement of the force applied by the muscles times the velocity of the movement). The average power over an exercise stroke, for example, can be accomplished by timing the duration of the stroke and measuring the distance traveled to determine the average velocity, and then multiplying the average velocity by the force (e.g., the weight moved or the resistance overcome by the muscles). However, because of the structure of most appendages in a person's body, the speed of an exercise stroke will vary throughout the stroke as the appendage varies from full extension to full contraction and the leverage of the muscles against the moving portion of the appendage changes.

During the course of an exercise or other physical development program an athlete or other user strives to continue improving his or her own capabilities with respect to strength and power. In a conventional training regimen, the user maintains a written log of the exercises performed on a given date, including, for example, the settings of the various exercise machines, the number of sets performed and the number of repetitions per set. Such written logs are often incomplete and may include mistakes in the entries of the data, either when writing the data or in remembering the number of sets and repetitions to record at each machine setting. Furthermore, in order to provide a meaningful summary of the exercises performed, it is necessary to transfer the information from the written log to another media (e.g., to storage media in a computer).

SUMMARY OF THE INVENTION

In view of the foregoing, it can be seen that a need exists for an improved apparatus and method for enabling an athlete or other user to maintain records of exercises performed during an exercise regimen or other program so that the user can determine whether the user's physical capabilities are improving. Furthermore, a need exists for a more meaningful way to determine a user's physical capabilities and to assist the user in training at a level best suited for improving the user's physical capabilities.

One aspect in accordance with embodiments of the present invention is a method for selecting a resistance level to use to train a muscle group for maximum power generation on an exercise apparatus having an engagement assembly movable against a controllable resistance by the muscle group of a user and having a monitoring system that measures a velocity of movement of the engagement assembly. The method comprises adjusting the controllable resistance to a first resistance level. The method monitors the movement of the engagement assembly against the first resistance level to determine a first velocity of movement of the engagement assembly. The method adjusts the controllable resistance to a second resistance level different from the first resistance level. The method monitors the movement of the engagement assembly against the second resistance level to determine a second velocity of movement of the engagement assembly. The method uses the first and second resistance levels and the first and second velocities of movement to determine a relationship between the resistance level and the velocity of movement of the engagement assembly. The method uses the relationship between the resistance levels and the velocities of movement to select a resistance level that corresponds to an overall maximum power generated by the user as the resistance level to use for training the muscle group for maximum power.

Preferably, the method monitors the movement of the engagement assembly against the first resistance level during a plurality of repetitions of the movement of the engagement assembly and selects as the first velocity a maximum velocity achieved in the plurality of movements. The monitoring system advantageously monitors a maximum number of repetitions before selecting the first velocity. If the first resistance level of the controllable resistance is adjusted to an adjusted first resistance level, the method resets the repetitions such that the first velocity is selected only after the maximum number of repetitions are performed at the adjusted first resistance level. The monitoring system advantageously displays a number representing the power generated during each repetition to provide the user with an incentive to increase the power on a subsequent repetition.

Also preferably, the method monitors the movement of the engagement assembly against the second resistance level during a plurality of repetitions of the movement of the engagement assembly and selects as the second velocity a maximum velocity achieved in the plurality of movements. The monitoring system monitors advantageously monitors a maximum number of repetitions before selecting the second velocity. If the second resistance level of the controllable resistance is adjusted to an adjusted second resistance level, the method resets the repetitions such that the second velocity is selected only after the maximum number of repetitions are performed at the adjusted second resistance level. The monitoring system advantageously displays a number representing the power generated during each repetition at the second resistance level to provide the user with an incentive to increase the power on a subsequent repetition.

Another aspect in accordance with an embodiment of the present invention is an apparatus for testing a muscle group to determine a resistance level to use to train the muscle group for maximum power generation. The apparatus comprises a controllable resistance and an engagement assembly movable against the controllable resistance by using a muscle group of a user. The apparatus further comprises a monitoring system that measures a velocity of movement of the engagement assembly when the controllable resistance is adjusted to a first resistance level to determine a first velocity. The monitoring system measures the velocity of movement of the engagement assembly when the controllable resistance is adjusted to a second resistance level different from the first resistance level to determine a second velocity. The monitoring system determines a relationship between the resistance level and the velocity achieved by the muscle group and selects a resistance level as a training resistance level where the training resistance level and a velocity at the training resistance level correspond to an overall maximum power. The apparatus further comprises a display unit that displays the training resistance level as the level to select for the controllable resistance for training the user at maximum power generation.

BRIEF DESCRIPTION OF THE DRAWINGS

Preferred embodiments of the present invention are described below in connection with the accompanying drawing figures in which.

DETAILED DESCRIPTION OF THE PREFERRED EMBODIMENTS

Figure 1:
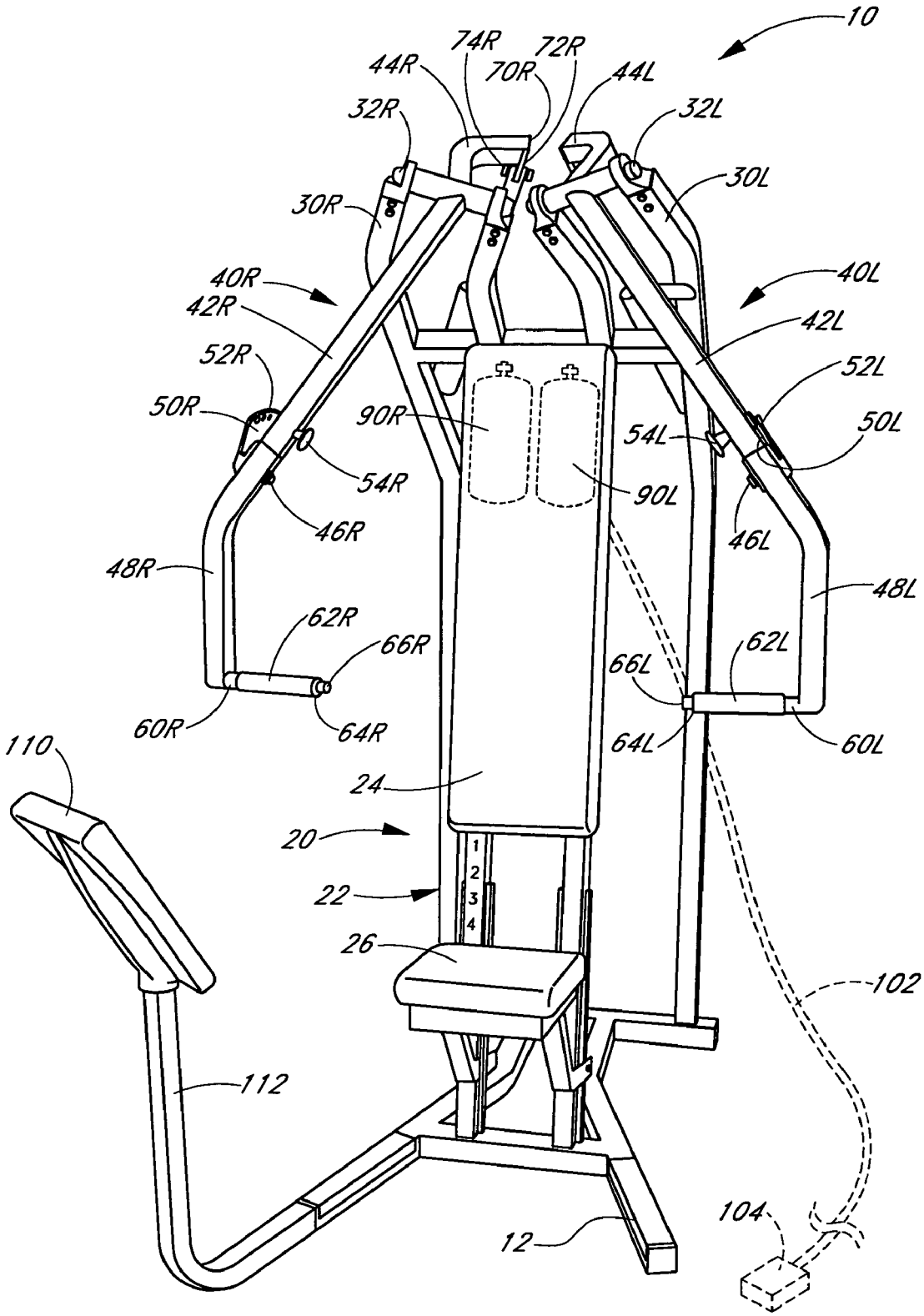
FIG. 1 illustrates a front view of an exercise and evaluation apparatus in accordance with a preferred embodiment.
Figure 2:
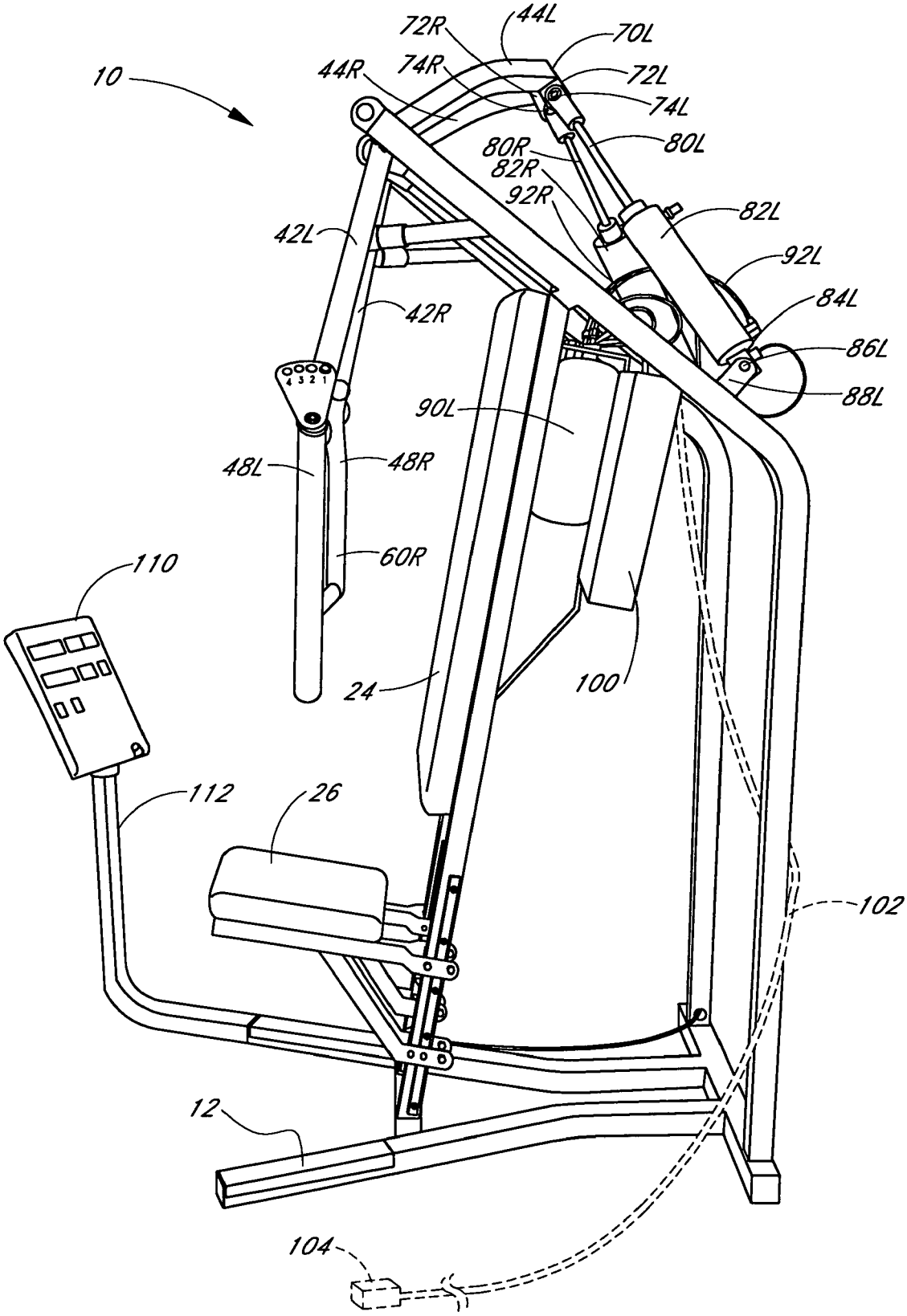
FIG. 2 illustrates a side view of the exercise and evaluation apparatus of FIG. 1.
Figure 3:
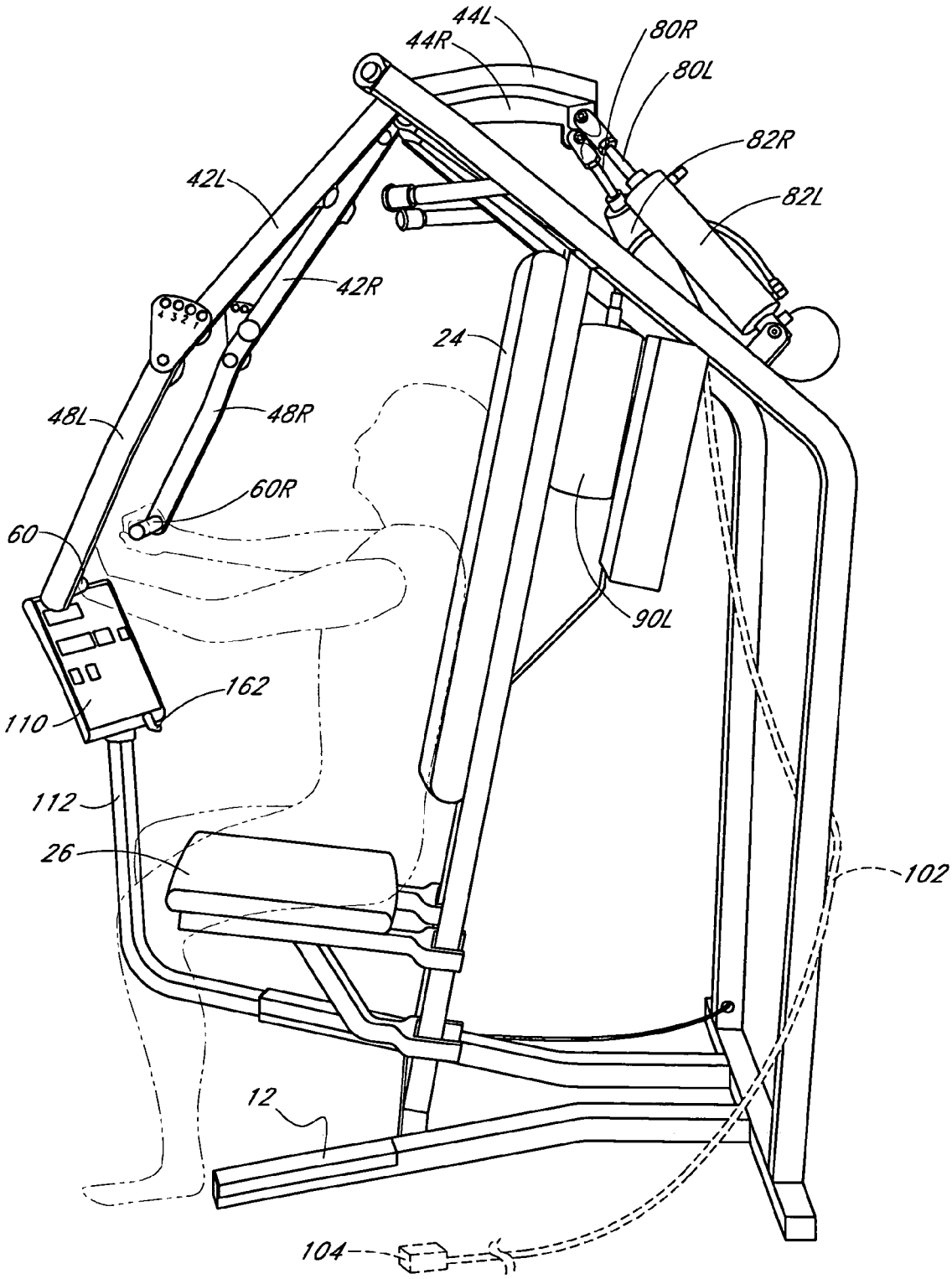
FIG. 3 illustrates a side view of the exercise and evaluation apparatus of FIGS. 1 and 2 with the position of a user of the apparatus shown in phantom.

FIGS. 1, 2, 3 and 4 illustrate an embodiment of an exemplary exercise apparatus 10 that can be used advantageously in connection with embodiments of the present invention for evaluating power generated by a muscle group when moving against levels of resistance that are varied to correspond to varying weights. Although described herein with respect to the apparatus 10, it should be understood that embodiments of the present invention can be incorporated into other exercise apparatuses. For example, the apparatus 10 is configured as a "chest press." The apparatus 10 can also be configured in other suitable configurations. Examples of other exercise equipment on which the performance measurement system can be used include, without limitation, a leg press, a leg extension machine, a leg curl machine, a standing hip machine, an abdominal machine, a lower back machine, an upper back machine, a lateral pull down machine, a military press machine, a triceps machine, an arm curl machine, a seated butterfly machine, a seated calf machine, a lateral shoulder raise machine, a squat machine, and a hip abductor machine, such as the types available commercially from Keiser Corporation, Fresno, Calif.

The apparatus 10 comprises a frame 12 having a lower portion that rests on a floor of an exercise facility or a fitness evaluation facility. The frame 12 has a generally vertical front portion 20 that supports a seat assembly 22. The seat assembly 22 comprises a seat back portion 24 and a seat bottom portion 26. Preferably, the seat bottom portion 24 is adjustable vertically to accommodate variations in the physical characteristics of users. In alternative embodiments, the seat back portion 24 is also adjustable to accommodate variations in lengths of the users' arms.

The frame 12 includes a left top portion 30L and a right top portion 30R. The two top portions 30L, 30R are cantilevered over the seat assembly 22. The left top portion 30L has a left hinge 32L positioned at the most forward and upward end. Similarly, the right top portion 30R has a right hinge 32R positioned at the most forward and upward end. As used herein, "left" and "right" are defined with respect to the position of a user of the apparatus 10. Thus, in the view shown in FIG. 1, the left top portion 30L and the left hinge 32L are on the right side of the drawing figure, and the right top portion 30R and the right hinge 32R are on the left side of the drawing figure.

A left lever 40L is pivotally mounted to the left hinge 32L, and a right lever 40R is pivotally mounted to the right hinge 32R. As described below, the left lever 40L and the right lever 40R in combination with their respective components each comprises an independent engagement apparatus for coupling the power from a user to respective resistance elements. The resistance elements are preferably implemented by left and right pneumatic cylinders, which are also described below.

The left lever 40L comprises a lower lever portion 42L that extends generally below and slightly forward of the left hinge 32L. The left lever 40L further comprises an upper lever portion 44L that extends generally above and to the rear of the left hinge 32L. In the illustrated embodiment, the lower lever portion 42L and the upper lever portion 44L comprise a unitary structure having the left hinge 32L formed at an intermediary location of the structure such that when the lower lever portion 42L moves forward and generally upward, the upper lever portion 44L moves rearward and generally downward.

Preferably, the lower lever portion 42L includes a hinge 46L at the lower end thereof. An extended lever portion 48L pivotally mounted to the lower lever portion 42L via the hinge 46L. An adjustment selector 50L is mounted to the extended lever portion 48L at the location of the hinge 46L. The adjustment selector 50L has a plurality of holes 52L formed therein (e.g., four holes in the illustrated embodiment). The holes 52L are selectably engageable with a spring-loaded pin 54L near the lower end of the lower lever portion 42L. The spring-loaded pin 54L can be temporarily disengaged from one of the holes 52L and the extended lever portion 48L can be pivoted about the hinge 46L to change the angle of the extended lever portion 48L with respect to the lower lever portion 42L to adapt the position of the extended lever portion 48L to the physical characteristics of a particular user. The spring-loaded pin 54L is re-engaged the most closely aligned one of the holes 52L to restrain the extended lever portion 48L at the selected angle.

In like manner, the right lever 40R comprises elements that generally correspond to the elements of the left lever 40L. The elements of the right lever 40R are positioned in similar locations and operate in similar manners as the corresponding elements of the left lever 40L. In particular, the right lever 40R comprises a lower lever portion 42R, an upper lever portion 44R, a hinge 46R, and an extended lever portion 48R. An adjustment selector 50R has a plurality of holes 52R. A selectable one of the holes 52R is engageable with a spring-loaded pin 54R to adjust the angle of the extended lever portion 48R with respect to the lower lever portion 42R.

In alternative embodiments, the extended lever portions 48L, 48R may be positioned at a fixed angle with respect to the respective lower lever portions 42L, 42L such that the hinges 46L, 46R and the selectors 50L, 50R are not needed.

The left lever 40L includes a left handgrip 60L that extends inward (e.g., towards the right) from the left extended lever portion 48L. Similarly, the right lever 40R includes a right handgrip 60R that extends inward (e.g., towards the left) from the right extended lever portion 166. In the illustrated embodiment, the handgrips 60L, 60R are positioned generally perpendicularly to the respective extended lever portions 48L, 48R. Each handgrip 60L, 60R has a length sufficient to accommodate the width of a user's hand and to further accommodate variations in the position of a user's hand. Preferably, each handgrip 60L, 60R is cylindrical and has a respective gripping surface 62L, 62R mounted thereon to assist a user in grasping the handgrips. The gripping surfaces 62L, 62R may advantageously be padded for the comfort of the user's hands.

The exposed end 64L of the left handgrip 60L supports a left actuator button 66L. Similarly, the exposed end 64R of the right handgrip 60R supports a right actuator button 66R. By pressing one of the actuator buttons 66L or 66R or by pressing both buttons 66L and 66R, a user is able to control various aspects of the operation of the apparatus 10, which will be discussed below.

A user seated in the seat assembly 22 is able to grip the handgrips 60L, 60R and apply forward forces to the extended lower portions 48L, 48R of the levers 40L, 40R to cause the extended lower portions 48L, 48R to move generally forwardly and upwardly. The levers 40L, 40R pivot about the respective hinges 32L, 32R such the respective upper lever portions 44L, 44R move generally rearward and downward.

Note that in the illustrated embodiment, the left lever 40L and the right lever 40R operate substantially independently. For example, one lever can be moved while the other lever remains at rest. As a further example, the two levers can be moved at different rates. In alternative embodiments (not shown), the two levers can be advantageously interconnected to move as a unit when the ability to exercise each arm independently is not needed.

A rearmost end 70L of the left upper lever portion 44L includes a left upper pivot mount 72L. The left upper pivot mount 72L supports a pivot pin 74L. A left connecting rod 80L extends from a first end of a left pneumatic cylinder 82L and is connected to the left upper lever portion 44L at the left upper pivot mount 72L via the pivot pin 74L.

A second end of the left pneumatic cylinder 82L includes a lug 84L having a pivot pin 86L mounted therein. The pivot pin 86L engages a left lower pivot mount 88L on a generally rearward portion of the left top portion 30L of the frame 12. Movement of the left upper lever portion 44L rearwardly and downwardly in response to forward force applied to the left handgrip 60L by a user causes the left connecting rod 80L to be moved into the left pneumatic cylinder 82L. An end (not shown) of the left connecting rod 80L comprises a piston that slides within the left pneumatic cylinder 82L. The left connecting rod 80L and the left pneumatic cylinder 82L comprise a linear actuator which functions as a resistance assembly for the left lever 40L. As the left connecting rod 80L moves into the left pneumatic cylinder 82L, the left connecting rod 80L pivots with respect to the left upper pivot mount 72L, and the second end of the left pneumatic cylinder 82L pivots with respect to the left lower pivot mount 88L so that the left connecting rod 80L can move freely with respect to the left pneumatic cylinder 82L without binding.

Similarly, an end 70R of the right upper lever portion 44R includes a right upper pivot mount 72R. The right upper pivot mount 72R supports a pivot pin 74R. A right connecting rod 80R extends from a first end of a right pneumatic cylinder 82R and is connected to the right upper lever portion 44R at the right upper pivot mount 72R via the pivot pin 72R.

A second end (not shown) of the right pneumatic cylinder 82R includes a lug (not shown) having a pivot pin (not shown) mounted therein. The pivot pin engages a right lower pivot mount (not shown) on a generally rearward portion of the right top portion 30R of the frame 12. Movement of the right upper lever portion 44R rearwardly and downwardly in response to forward force applied to the right handgrip 60R by a user causes the right connecting rod 80R to be moved into the right pneumatic cylinder 82R. An end (not shown) of the right connecting rod 80R comprises a piston that slides within the right pneumatic cylinder 82R. The right connecting rod 80R and the right pneumatic cylinder 82R comprise a linear actuator which functions as a resistance assembly for the right lever 40R. As the right connecting rod 80R moves into the right pneumatic cylinder 82R, the right connecting rod 80R pivots with respect to the right upper pivot mount 72R, and the second end of the right pneumatic cylinder 82R pivots with respect to the right lower pivot mount so that the right connecting rod 80R can move freely with respect to the right pneumatic cylinder 82R without binding.

Within each pneumatic cylinder 82L, 82R, the respective piston divides the cylinder body into two variable volume chambers. At least one of the chambers is a charged chamber that selectively communicates with a compressed air source (shown schematically in FIG. 5) and with the atmosphere so as to provide the desired resistance. The other chamber can be open to the atmosphere; however, in some applications, both chambers can be pressurized (e.g., be of equal pressure), can selectively communicate with the atmosphere and/or can communicate with each other. In the illustrated embodiment, however, one of the chambers communicates with the atmosphere so as not to resist movement of the piston.

The pneumatic cylinders 82L, 82R may be advantageously constructed from metal or other suitable materials. In one preferred embodiment, the pneumatic cylinders 82L, 82R and the internal pistons comprise a polymer (e.g., plastic) to reduce the manufacturing costs and the weight of the resistance assemblies.

In the illustrated embodiment, the respective connecting rod 80L, 80R extends through the variable volume chamber open to the atmosphere. The respective connecting rod 80L, 80R moves linearly along a stroke axis as the piston slides within the cylinder bore in the respective pneumatic cylinder 82L, 82R. The stroke lengths of the connecting rods 80L, 80R are sufficient to provide the desired strokes for the upper lever portions 44L, 44R.

In the illustrated embodiment, the internal chamber proximate the respective second end of each pneumatic cylinder 82L, 82R (e.g., the lower chamber of each cylinder) is pressurized. The lower chamber of the left pneumatic cylinder 82L communicates with at least one left accumulator 90L via a pneumatic tube 92L, as shown more clearly in FIG. 5. Similarly, the lower chamber of the right pneumatic cylinder 82R communicates with at least one right accumulator 90R via a pneumatic tube 92R. The two accumulators 90L, 90R are located behind the seat back portion 24 in the illustrated embodiment and are secured to the frame 12. The pneumatic tubes 92L, 92R function as respective air equalization lines that interconnect the accumulators 90L, 90R with the respective pneumatic cylinders 82L, 82R so as to expand effectively the variable volumes of the lower chambers of the two cylinders. In this manner, the effective air volume of the cylinder is increased, and air pressure thus will not increase as dramatically when the piston is moved.

Each accumulator 90L, 90R and the respective upper chamber within the pneumatic cylinders 82L, 82R also selectively communicate with the compressed air source (FIG. 5) and with the atmosphere. In the illustrated example, the compressed air source may be, for example, an air compressor, which can be remotely disposed relative to the exercise apparatus. The compressed air source communicates with the upper chambers through a respective inlet valve (shown schematically in FIG. 5). In the illustrated embodiment, the inlet valves for both pneumatic cylinders 82L, 82R are controlled by the left actuator button 66L on the left handgrip 60L when a user manually controls the resistance of the two pneumatic cylinders. The left actuator button 66L is selectably activated by a user to actuate the inlet valves to add air pressure to the lower chamber of each pneumatic cylinder 82L, 82R. The lower chamber is also referred to as the charged side of each cylinder.

The apparatus 10 further includes a control unit enclosure 100 that houses a control system 200 (described in more detail below in connection with FIGS. 5-11). In certain embodiments, the control system 200 within the enclosure 100 is optionally capable of communicating with an external computer system 250 (FIGS. 5 and 6) via a communications cable 102 and an adapter unit 104 (both shown in phantom to indicate that the elements are optional). The communications cable 102, the adapter unit 104 and the external computer system 250 are not necessary to an understanding of embodiments described herein and will not be discussed further.

The apparatus 10 further includes a control and display panel 110 supported on a riser 112 so that the display panel 110 is positioned in front of a user seated in the seat assembly 22.

Figure 4:
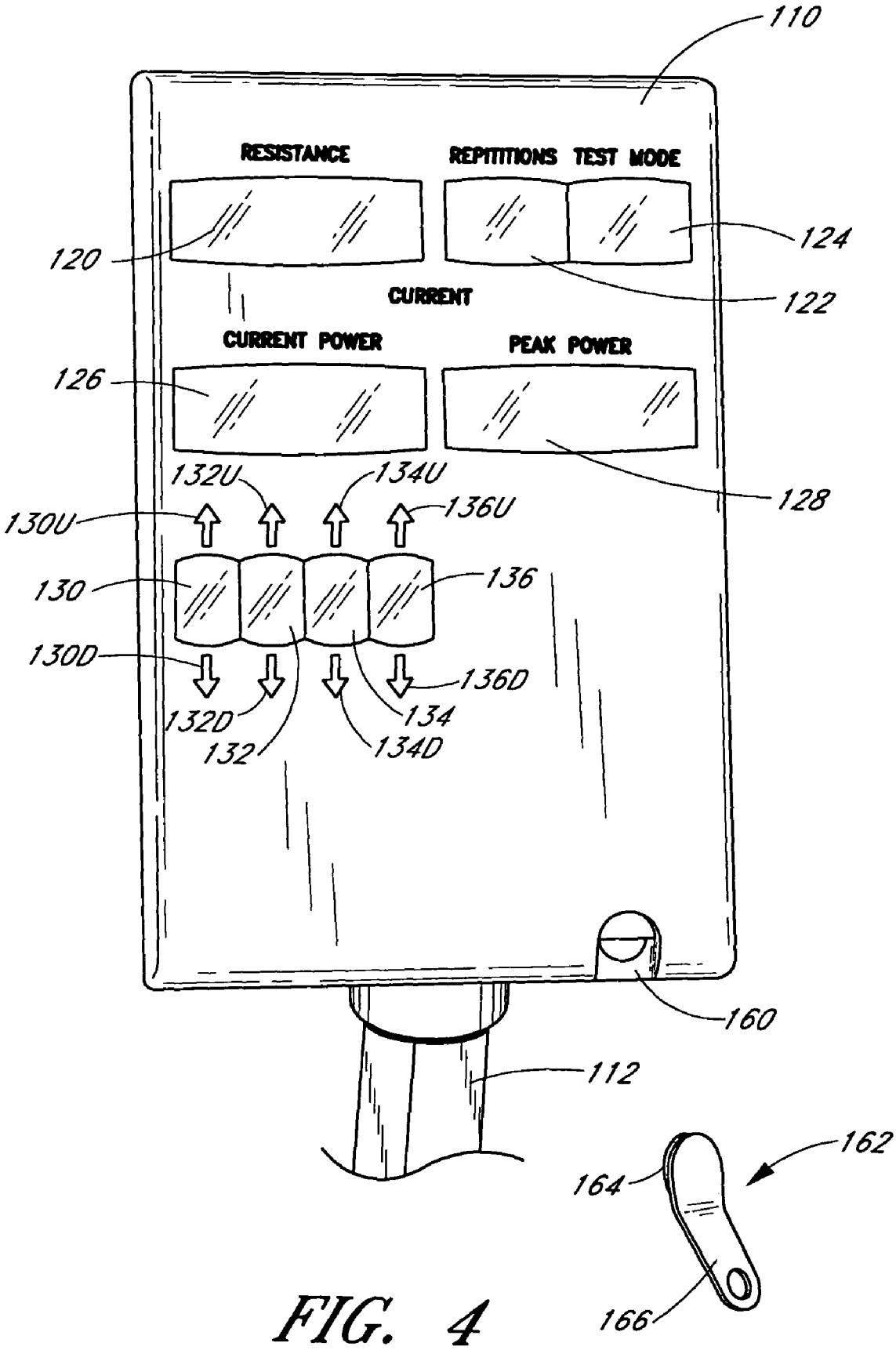
FIG. 4 illustrates a front view of a display panel for the exercise and evaluation apparatus of FIGS. 1, 2 and 3 and the data key that enables the evaluation features in accordance with a preferred embodiment.

As shown in FIG. 4, the display panel comprises a RESISTANCE indicator 120 that displays the total resistance applied to the two handgrips 60L, 60R. In the embodiment described herein, the total resistance may be selected by a user by selectively activating the right actuator button 66R to increase the resistance and selectively activating the left actuator button 66L to decrease the resistance. In alternative embodiments, the resistance may also be selected automatically. The resistance is displayed as the force (in pounds or kilograms) required to move the handgrips 60L, 60R and is calibrated to be equivalent to the force required to move a corresponding stack of conventional weights.

In alternative embodiments of the apparatus 10 in which handgrips are not used or where hand-operated actuators cannot be readily incorporated, the controls for increasing and decreasing the resistance may be implemented as foot pedals (not shown).

In certain embodiments in which the display unit 110 and control system 200 are powered by batteries rather than by AC power, the resistance indicator 120 is advantageously caused to display OFF rather than a resistance value in order to indicate that the control system 200 and display unit 110 have gone into a low power consumption (e.g., "sleep") mode to increase battery life. A user wanting to activate a system in the low power consumption mode can push one of the resistance change buttons (e.g., the left actuator button 66L or the right actuator button 66R in the illustrated embodiment, or a foot pedal in an alternative embodiment) or the user can insert a data key 162. The resistance indicator can also be advantageously used to display the characters Loba to indicate that the batteries supplying the control system 200 and the display unit 110 are low and need to be replaced.

The display unit 110 also advantageously includes a REPETITIONS indicator 122, a TEST MODE indicator 124, a CURRENT POWER indicator 126, a PEAK POWER indicator 128, a first machine adjustment indicator 130, a second machine adjustment indicator 132, a third machine adjustment indicator 134, and a fourth machine adjustment indicator 136. The display unit 110 also includes respective up arrows 130U, 132U, 134U, 136U, above the respective machine adjustment indicators, and includes respective down arrows 130D, 132D, 134D, 136D, below the respective machine adjustment indicators. Each of the up arrows and down arrows defines a respective location of a switch beneath the faceplate of the display unit 110. Each switch can be selectively activated by a user pressing on the respective arrow.

The machine adjustment indicators 130, 132, 134, 136 are advantageously used to indicate various settings of the apparatus 10 that can be adjusted by users to accommodate differences in body structures. For example, in the embodiment described herein, the first adjustment indicator 130, for example, is advantageously assigned to indicate the vertical position of the seat bottom portion 24 of the seat assembly 22. In the illustrated embodiment, the second adjustment indicator 132, for example, is advantageously assigned to indicate the position of arm adjustment selectors 50L, 50R. In alternative embodiments where the seat back portion 24 of the seat assembly 22 is adjustable, one of the adjustment indicators may be assigned to indicate the position of the seat back portion 24. In other types of exercise equipment (for example, equipment having an adjustable chest pad, or the like), an adjustment indicator is advantageously assigned to indicate the position of the adjustable portion of the equipment. It should be understood that in exercise equipment having fewer than four adjustable portions, one or more of the adjustment indicators may not be used. The use of the adjustment indicators in connection with embodiments of the present application will be described in more detail below.

The display unit 110 includes a data port recess 160 near the lower right corner of the display unit 110. The data port recess 160 is configured to receive a data key 162. The data key 162 comprises an integrated circuit 164 and a supporting handle 166. In one embodiment, the integrated circuit 164 on the data key 162 comprises an iButton® data device available from Maxim/Dallas Semiconductor Corporation. A compatible interface, also available from Maxim/Dallas Semiconductor Corporation, is positioned in the data port recess 160 of the display unit 110 to communicate with the integrated circuit 164 when the data key 162 is present. A non-volatile memory within the integrated circuit 164 stores user identification information and advantageously includes historical information related to the user.

The functions of the indicators, the switches, the data port recess and the data key with respect to the embodiment herein are described in more detail below.

The control unit enclosure 100 is pneumatically connected to the accumulators 90L, 90R and is thus connected to the charged side of the pneumatic cylinders 82L, 82R. The control unit enclosure is also pneumatically connected to a compressed air source (not shown). Within the control unit enclosure 100, a respective inlet valve (shown schematically in FIG. 5, discussed below) for each accumulator 90L, 90R selectively routes compressed air to the accumulator to increase the air pressure in the accumulator and thus increase the air pressure on the charged side of the corresponding pneumatic cylinder. In preferred embodiments, each inlet valve comprises two inlet valves of varying sizes. A larger inlet valve is selectively activated by a control system (described below) to increase the volume of air in the cylinder rapidly when the resistance level of a pneumatic cylinder is increased. A smaller inlet valve is selectively activated by the control system to increase the volume of air in the cylinder in finer increments when the control system is maintaining a selected resistance level. Of course, one skilled in the art will appreciate other embodiments can also be used to vary the resistance level.

A respective outlet valve (shown schematically in FIG. 5) for each accumulator is selectively opened to release air to the atmosphere in order to decrease the air pressure on the charged side of the cylinder. In the illustrated embodiment, the outlet valves for both pneumatic cylinders 82L, 82R are controlled by the left actuator button 66L on the left handgrip 60L when a user manually controls the resistance of the two pneumatic cylinders. The left actuator button 66L is selectably activated by a user to actuate the outlet valves to reduce the air pressure to the lower chamber of each pneumatic cylinder 82L, 82R.

A user thus can adjust (e.g., increase or decrease) the air pressure within each resistance assembly by operating the appropriate valves using the right actuator button 66R and the left actuator button 66L. In alternative embodiments (not shown), the user can adjust the air pressure using control switches actuated in other ways (e.g., using foot pedals or the like).

Although the right actuator button 66R and the left actuator button 66L could be connected directly to the inlet valves and the outlet valves respectively, in the illustrated embodiment it is preferably that the pressure in the left pneumatic cylinder 82L and the pressure in the right pneumatic cylinder 82R be substantially equal so that the resistance applied to the left handgrip 60L and the resistance applied to the right handgrip 60R are substantially equal. In the illustrated embodiment, this is accomplished by providing a respective actuator signal from each actuator button 66R, 66L to a control system 200 (illustrated in block diagrams in FIG. 5 and FIG. 6) that is located within the control unit enclosure 100. Although represented as a single control system, in the preferred embodiment, the control system 200 comprises a plurality of microprocessors programmed to perform specific functions, such as real-time measurement and adjustment of air pressures, real-time measurement of positions and computation of velocities, communicating with the user via the display panel, and the like.

Figure 5:
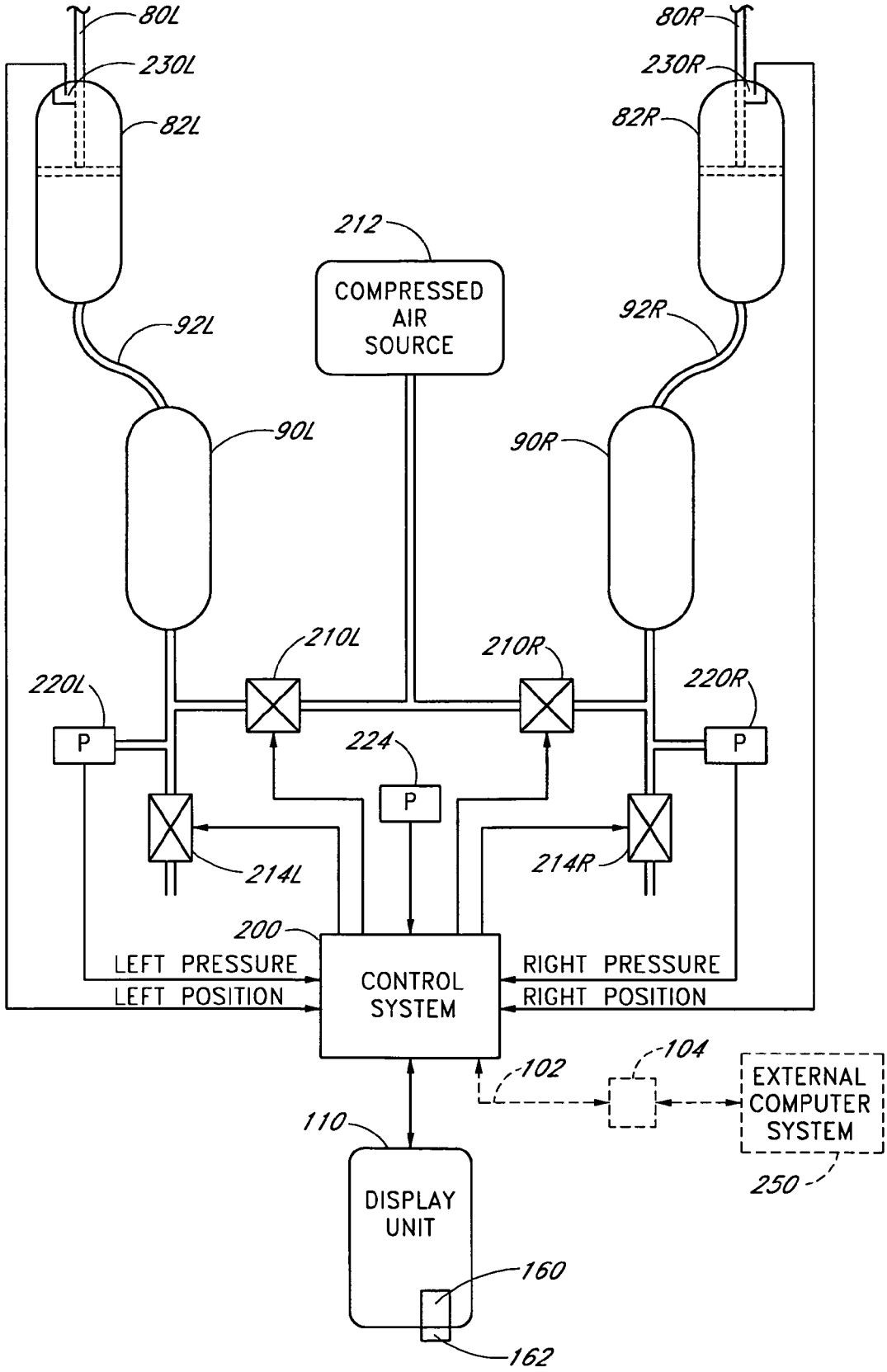
FIG. 5 illustrates a simplified control diagram in accordance with a preferred embodiment.

In a simplified embodiment illustrated in FIG. 5, the control system 200 receives the respective actuator signals and determines whether the user is requesting a pressure increase or a pressure decrease. The control system 200 outputs control signals to a left inlet valve 210L and to a right inlet valve 210R to selectively couple the left accumulator 90L, the right accumulator 90R or both accumulators to a compressed air source 212 to selectively increase the air pressure in one or both accumulators 90L, 90R and the corresponding pneumatic cylinders 82L, 82R. As discussed above, each inlet valve 210L, 210R advantageously comprises a pair of inlet valves. In particular, a large inlet valve in a pair is selectively operated to provide coarse adjustment of the air pressure in the respective pneumatic cylinder. A small inlet valve in a pair is selectively operated to provide fine adjustment of the air pressure in the respective pneumatic cylinder.

The control system 200 outputs control signals to a left outlet valve 214L and to a right outlet valve 214R to selectively release air from one or both accumulators 90L, 90R to selectively decrease the air pressure in the respective pneumatic cylinders 82L, 82R. The inlet valves and the outlet valves are selectively controlled to achieve the desired pressure change while maintaining substantially equal resistances provided by the two pneumatic cylinders 82L, 82R. The control system 200 accomplishes this by receiving a feedback signal from a left pressure transducer 220L coupled to the left pneumatic cylinder 82L and by receiving a feedback signal from a right pressure transducer 220R coupled to the right pneumatic cylinder 82R. The control system 200 samples the feedback signals periodically (e.g., at a sample rate of 10 times per second in one embodiment and at a sample rate of 50 times per second in another embodiment having proportional valves) to determine the gage pressures measured in the cylinders. The gage pressure is added to the ambient barometric pressure that is also periodically measured using a barometric pressure transducer 224 in order to determine the absolute pressure in each cylinder. The absolute pressure in each cylinder is compared to a calculated desired absolute pressure, and the control system 200 then adjusts the control signals applied to the inlet valves and outlet valves accordingly to achieve the desired absolute pressure. In alternative embodiments, the barometric pressure transducer 224 is not included, and the barometric pressure is estimated from an altitude setting provided as an input to the control system 200.

Figure 6:
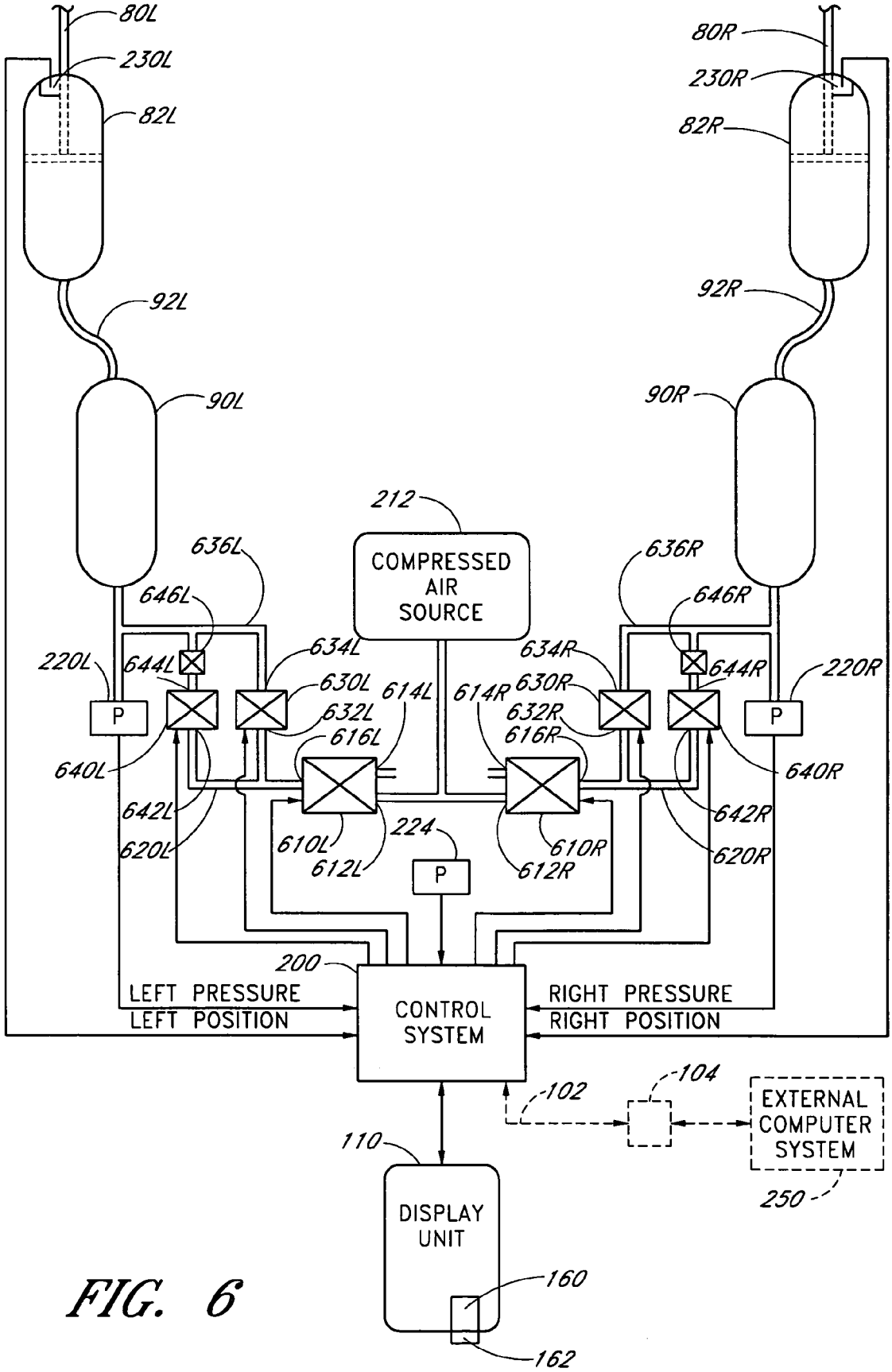
FIG. 6 illustrates a simplified control diagram similar to FIG. 5 but having a different configuration of control valves.

FIG. 6 illustrates a block diagram of a preferred embodiment of the system in which the control system 200 controls a different configuration for the control valves. Many elements of the block diagram in FIG. 6 are similar to corresponding elements of the block diagram in FIG. 5 and are numbered accordingly. The following description is directed to the elements of the block diagram of FIG. 6 that are not in FIG. 5.

In FIG. 6, a first left control valve 610L has a first port 612L coupled to the compressed air source 212. The first left control valve 610L has a second port 614L coupled to the atmosphere. The first left control valve 610L has a third port 616L coupled to a left common galley 620L. The first left control valve 610L is controlled by the control system 200 to be in one of two modes. In a first mode, the first port 612L is coupled to the third port 616L so that the left common galley 620L is coupled to the compressed air source 212. In the second mode, the second port 614L is coupled to the third port 616L so that the left common galley 620L is coupled to the atmosphere.

The left common galley 620L is coupled to a first port 632L of second left control valve 630L and to a first port 642L of a third left control valve 640L. A second port 634L of the second left control valve 630L is coupled to the left accumulator 90L and to the left pressure transducer 220L via a pneumatic tube 636L. A second port 644L of the third left control valve 640L is coupled to the pneumatic tube 636L via an adjustable orifice 646L. Although shown as a separate element, the adjustable orifice 646L may advantageously be included as part of the third control valve 640L.

The second left control valve 630L and the third left control valve 640L are controlled by the control system 200. The second left control valve 630L operates as a high flow valve. The control system 200 activates the second left control valve 630L to make course adjustments to the volume of air in the accumulator 90L and the pneumatic cylinder 82L. The third left control valve 640L operates as a low flow valve. The control system 200 activates the second left control valve 630L to make fine adjustments to the volume of air in the accumulator 90L and the pneumatic cylinder 82L in accordance with the flow rate determined by the adjustable orifice 640L.

The control system 200 operates the first left control valve 610L in combination with the second left control valve 630L and the third left control valve 640L. The mode of the first left control valve 610L determines whether the volume of air in the left accumulator 90L and the left pneumatic cylinder 82L is being increased or decreased and the selective activation of the second left control valve 630L or the third left control valve 640L determines a rate at which the increase or decrease in volume occurs.

Similarly, a first right control valve 610R has a first port 612R coupled to the compressed air source 212, a second port 614R coupled to the atmosphere, and a third port 616R coupled to a right common galley 620R. The first right control valve 610R is controlled by the control system 200 to be in one of two modes as described above for the first left control valve 610L.

The volume of air in the right accumulator 90R and the right pneumatic cylinder are controlled by a second right control valve 630R having a first port 632R and a second port 634R and third right control valve 642R having a first port 642R, a second port 644R and an adjustable orifice 646R. The right accumulator 90R and the right pressure transducer 220R are coupled to the second port 634R of the second right control valve 630R and to the adjustable orifice 646R by a pneumatic tube 636R.

The second right control valve 630R and the third right control valve 640R are controlled by the control system 200 in combination with the first right control valve 610R to make course adjustments and fine adjustments to the volume of air in the accumulator 90R and the pneumatic cylinder 82R as discussed above for the corresponding left components.

The control system 200 uses the pressure measurements to calculate the resistive force that will be perceived by a user when the handgrips are moved. The calculated resistive force is advantageously displayed as the resistance on the RESISTANCE indicator 120 of the display unit 110 so that a seated user can readily observe the resistance selected by using the left actuator button 66L and the right actuator button 66R. As discussed above, the resistance is displayed as the force (preferably in pounds or kilograms) required to move the handgrips 60L, 60R and is calibrated to be equivalent to the force required to move a corresponding stack of conventional weights.

Once the pressures in the pneumatic cylinders are established by the control system 200, the user can apply force to the left handgrip 60L and apply force to the right handgrip 60R to move the handgrips forward. The forward movement of the handgrips is coupled via the pivoting action of the left lever 40L and the right lever 40R about the left hinge 32L and the right hinge 32R to cause the left connecting rod 80L and the right connecting rod 80R to move within the left pneumatic cylinder 82L and the right pneumatic cylinder 82R. As discussed in U.S. Pat. No. 4,257,593, incorporated by reference herein, the air within the pneumatic cylinders 82L, 82R and the accumulators 90L, 90R is compressed as the pistons move within the cylinders. The force required to compress the air is coupled through the levers to oppose the movement of the handgrips to provide the user with the effect of lifting weights against gravity but without the inertial effects of conventional weights. It will be appreciated that as the pistons move farther into the respective cylinders, the force required to further compress the air increases; however, the shapes of the upper lever portions 44L, 44R are selected such that the user is provided with increasingly more leverage to compensate for the increased air pressure. Thus, the user pushes against substantially the same force throughout each exercise stroke. The shapes of the upper lever portions and parameters of other elements can be modified in alternative embodiments to adjust the shape of the force curve in each stroke for specific applications.

In addition to the mechanical control of the force provided by the shapes of the upper lever portions 44L, 44R, the force is also controlled by the control system 200, which continues to sample the pressure transducers (e.g., at 10 times or 50 times per second) throughout each exercise stroke and selectively applies control signals to the inlet valves and the outlet valves to maintain the correct pressure in each pneumatic cylinder throughout the exercise stroke. Since the pressure is intended to vary throughout the exercise stroke, the control system 200 must also determine the position of each cylinder throughout the stroke. This is accomplished in the preferred embodiment by precisely measuring the position of each cylinder. In particular, the position of the piston within the left pneumatic cylinder 82L is determined by a left position transducer 230L, and the position of the piston within the right pneumatic cylinder 82R is determined by a right position transducer 230R. In the illustrated embodiment, each of the position transducers 230L, 230R is implemented by a resistive position transducer having a resolution of 1 part in 16,000,000 and having a linearity of better than 1 percent. Each position transducer 230L, 230R is sampled 400 times per second to determine the instantaneous position of the piston.

The control system 200 uses the measured positions of each piston to determine the instantaneous volume of the air in each cylinder. The control system 200 uses the measured barometric pressure and the measured pressures in each cylinder as inputs and solves the universal gas law equation ten times per second (or fifty times per second in an alternative embodiment having proportional valves) to determine whether to add or remove air from each cylinder to maintain the desired resistance at each position in the exercise stroke. The control system 200 also measures the supply pressure provided by the compressor (not shown) via a storage accumulator (not shown) to determine the amount of time to open a respective air inlet valve in order to add the proper amount of air to a cylinder.

As further illustrated in phantom in FIGS. 5 and 6, the control system 200 for certain embodiments of the exercise apparatus 10 is selectively coupled via the communications cable 102 and the adapter 104 to an external computer system 250. The computer system 250 is not utilized in connection with the embodiment described herein and is not discussed in further detail.

The apparatus 10 is used for exercising the muscles to increase the performance of the muscles. Although the apparatus 10 can be advantageously used as an exercise device by simply setting the resistance and then moving the handles as if the handles were coupled to conventional iron weights, a unique benefit of the apparatus 10 is not achieved in that manner. Rather, when the apparatus 10 is utilized in accordance with the system and method described below, a user is enabled to consistently exercise at a resistance level selected to develop the user's power. One aspect of the embodiments described herein is the use of the data key 162 and the data port recess 160 to control the display unit 110 to provide information to the user and to set parameters of the apparatus 10.

In accordance with one aspect of the particular embodiment described herein, the data key 162 is an electronic replacement for a hand written exercise card. Each user is advantageously provided with a data key 162 into which workout data is stored, as described below. The data key 162 is carried by the user, and is inserted into the data port recess 160 of the display unit 110 of an apparatus 10 that the user wants to operate. In preferred embodiments, the data key 162 stores settings for up to 24 separate machine models and for up to 240 separate workout sets for the user. As discussed in more detail below, the integrated circuit 164 in the data key 162 includes an electronic memory chip. The data key 162 also includes a battery (not shown). The battery life is designed to be at least 10 years under normal operating conditions. Up to four adjustment machine settings may be stored for each machine model number depending on the adjustments available for a particular model. For example, the data key 162 stores the seat position and the arm position for the chest press apparatus 10 described herein. For other exercise apparatuses, the data key 162 advantageously stores the position of a chest pad for a seated rowing machine, the position of a pressure pad on a leg curl machine, the angle of an inclined support on a leg press machine, and the like, depending on the needs of the particular model. As discussed above, not all models use all four available settings. The features of the display unit 110 may vary in alternative embodiments.

For each workout, the data key 162 stores the time and date of the workout at each machine, the resistance used during the workout, the number of repetitions during each set, and the version and serial number of the software in the machine being used for a particular workout. The data key 162 also stores data related to a power test if the user selects the power test mode (described below).

As discussed above, the apparatus 10 can be used as an exercise device only. In particular, the electronic display 110 provides digital indications of the resistance value and the repetition count when a user operates the apparatus 10 without inserting a data key 162 into the data port 160. The software in the control system 200 advantageously calculates the peak power produced on each repetition and displays the peak power as the current power on the current power indicator 126. The software also maintains a record of the highest peak power achieved during any repetition and displays that value on the peak power indicator 128.

The embodiment described herein provides additional functionality when a user inserts a data key 162 into the data port 160. When the data key 162 is inserted, certain indicators provide additional information to the user that automatically keeps track of the parameters of the exercise routine (e.g., the adjustment settings for a particular machine), thus relieving the user of a burden of maintaining a handwritten exercise card. In addition, the display unit 110 is responsive to the presence of the data key 162 to selectively enable a test mode that is particularly advantageous for assisting a user training to achieve increased power.

As discussed above, the repetitions indicator 122 generally displays the current repetition count. However, when the data key 162 is inserted into the data port recess 160, the repetitions indicator 122 displays the current set for a selected time interval following the insertion. The set count ranges from 1 to 9 and is signaled by the appearance of 3 horizontal bars in the left digit position instead of a number. The number of sets is defined as the number of sets of exercises that have been performed by the same user on the same machine in a four-hour period. If four hours have passed since the user completed the previous workout at the same machine, the control system 200 assumes that the user is returning for a new visit.

After displaying the set count for a few seconds, the repetitions indicator 122 displays the repetition count for the current set. The repetition count advantageously ranges from 0 to 99 in the illustrated embodiment. The repetition count may be reset by momentarily depressing both the increase actuator button and the decrease actuator button (e.g., the left actuator button 66L and the right actuator button 66R in the described embodiment or the foot pedals (not shown) in an alternative embodiment).

As discussed below, the repetitions indicator also provides a further function when the display unit 110 and the control system 200 are enabled to perform a power test in accordance with embodiments of the present application.

The test mode indicator 124 displays the number of repetitions that were performed on the corresponding set of the previous visit if that set was a normal workout set when a chip is inserted. If the corresponding set of the previous visit was a power test (described below), the test mode indicator 124 displays the characters Pr. If the user enables the display 110 and the control system 200 to operate in the test mode, as described below, the test mode indicator 124 displays the characters P1 during the high velocity portion of the test and displays the characters P2 during the high resistance portion of the test.

The current power indicator 126 displays 4 different values in accordance to the state of the control system 200. During a conventional exercise set, the current power indicator 126 displays the peak power that has been achieved for the most recent repetition. At the end of a power test (described below), the current power indicator 126 displays the resistance that the user should select in order to achieve maximum power.

When a user inserts the data key 162 into the data port recess 160 of the display unit 110 of the apparatus 10, the control system 200 evaluates the data stored in the data key 162 for the particular apparatus 10. If the stored data indicates that the previous set by that user on that particular apparatus was a normal workout set (e.g., the test mode indicator 124 displays the number of repetitions), the current power indicator 126 temporarily displays the resistance that was used for the previous corresponding set. The user can then activate the appropriate actuator buttons to adjust the resistance level to the previous workout level. In contrast, if the data stored in the data key 162 for that particular apparatus indicates that the previous set for the user on that apparatus was a power test (e.g., the test mode indicator 124 initially displays the characters Pr, as discussed above), the current power indicator 126 displays the resistance to use to achieve maximum power, as determined during the previous power test. When the calculated resistance to achieve maximum power is being displayed, the current power indicator 126 flashes to indicate to the user that the resistance rather than the power is being displayed.

In summary, during an exercise set, the current power indicator 126 displays the power for the current repetition; at the end of a power test the current power indicator 126 displays the resistance to use for training at maximum power; and when a data key 162 is inserted into the data port recess 160, the current power indicator 126 displays the resistance that the user should set into the resistance indicator 120 before beginning the exercise.

As discussed above, the peak power indicator 128 displays the highest power that has occurred during the current workout session or since the data saved in the user's data key 162 was last reset.

As discussed above, the machine adjustment indicators 130, 132, 134, 136 display from one to four machine adjustments depending upon the model of exercise apparatus being used. The first time a user works out on a particular machine, the user adjusts the machine (e.g., the seat height and the arm position in the illustrated embodiment) and enters the selected positions in the respective adjustment indicator by pressing the arrows located directly above or below each indicator. For example, the user can increase the value displayed by the first adjustment indicator by pressing the up arrow 130U and can decrease the value by pressing the down arrow 130D. Preferably, the adjustments may only be changed in a time window starting immediately after the data key 162 is inserted and ending before the user begins a third repetition. Once three repetitions are performed in a current workout session, the machine adjustments cannot be changed until the data key 162 has been removed and reinserted. Machine adjustments apply to a machine and cannot be changed from set to set. The adjustments for a particular machine are saved on the user's data key 162. Thus, when the user returns to the same machine and inserts the data key 162 in the data port recess 160, the previously stored adjustment data values for that machine are displayed to remind the user of the settings. Thus, the user is able to quickly adjust the machine to the appropriate settings without having to refer to a handwritten exercise card.

In the embodiment described above, the results of the power testing are displayed on the user display 110. In alternative embodiments, the results are not displayed on the user display 110. Rather, the results are transferred to the external computer system 250 only.

As briefly discussed above, one particularly advantageous use for the embodiment described herein is to perform a power test to determine a user's maximum power for the muscle groups that are exercised by a particular machine and to determine the resistance at which the maximum power is achieved. With this information, a user is able to consistently exercise the muscle groups at the optimal resistance for achieving the maximum power and to strive to increase the maximum power produced by the muscle groups.

Figure 7:
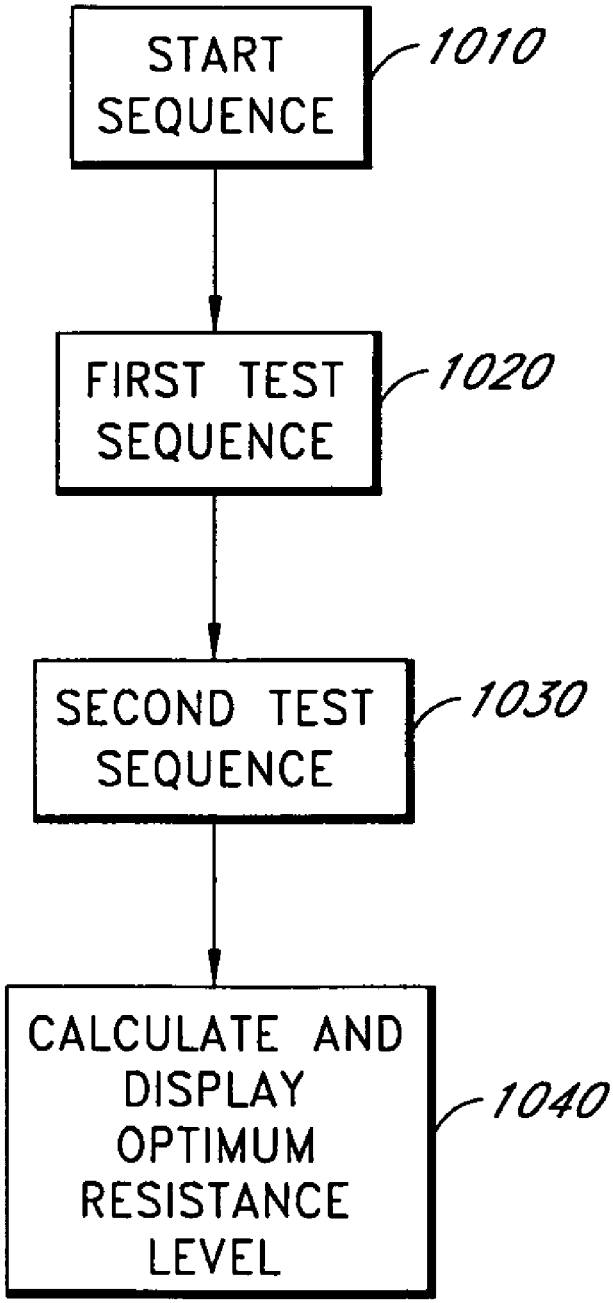
FIG. 7 illustrates a flow chart of a test mode in accordance with a preferred embodiment.

One embodiment of the power test is illustrated by the flow chart in FIGS. 7-11. As illustrated in FIG. 7, the test comprises a start sequence 1010. The start sequence 1010 is followed by a first test sequence 1020, which is performed at a very low resistance. The first test sequence 1020 is followed by a second test sequence 1030, which is performed at a high resistance. Preferably, the high resistance is selected to be near a maximum resistance for the user for the particular apparatus 10. For both test sequences, the user is encouraged to perform each repetition against the resistance as fast as the user can in order to achieve the maximum velocity since a higher velocity at a given resistance results in higher power. The second test sequence 1030 is followed by an action block 1040 in which the values from the first test sequence 1020 and the second test sequence 1030 are used to calculate an optimum resistance value for the user to set for the particular apparatus in order to provide optimum power training.

Figure 8:
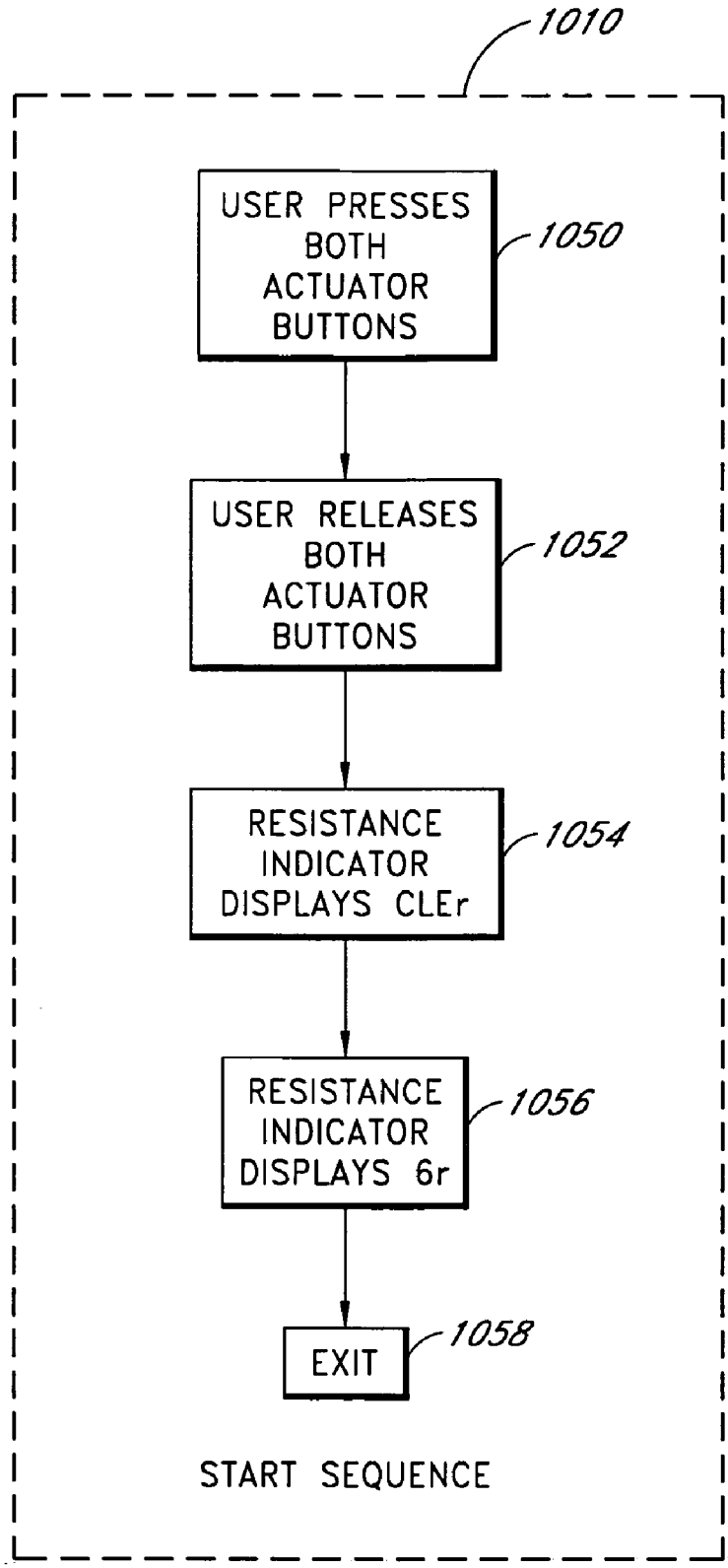
FIG. 8 illustrates a flow chart of the start sequence of the test mode of FIG. 7 in accordance with a preferred embodiment.

As illustrated in more detail in FIG. 8, within the start sequence 1010, the user pushes both actuator buttons 66L and 66R at the same time until the characters 6*r* appear in the resistance indicator 120, as illustrated by an action block 1050. The user then releases both actuator buttons immediately in an action block 1052. The resistance indicator 120 displays the characters CLEr for a few seconds in an action block 1054. Thereafter, the resistance indicator 120 again displays the characters 6*r* in an action block 1056 to indicate that the control system 200 of the apparatus 10 is in the test mode. The control system 200 exits the test sequence 1010 via an exit block 1058 to perform the actions of the first test sequence 1020 illustrated in FIG. 9.

Figure 9:
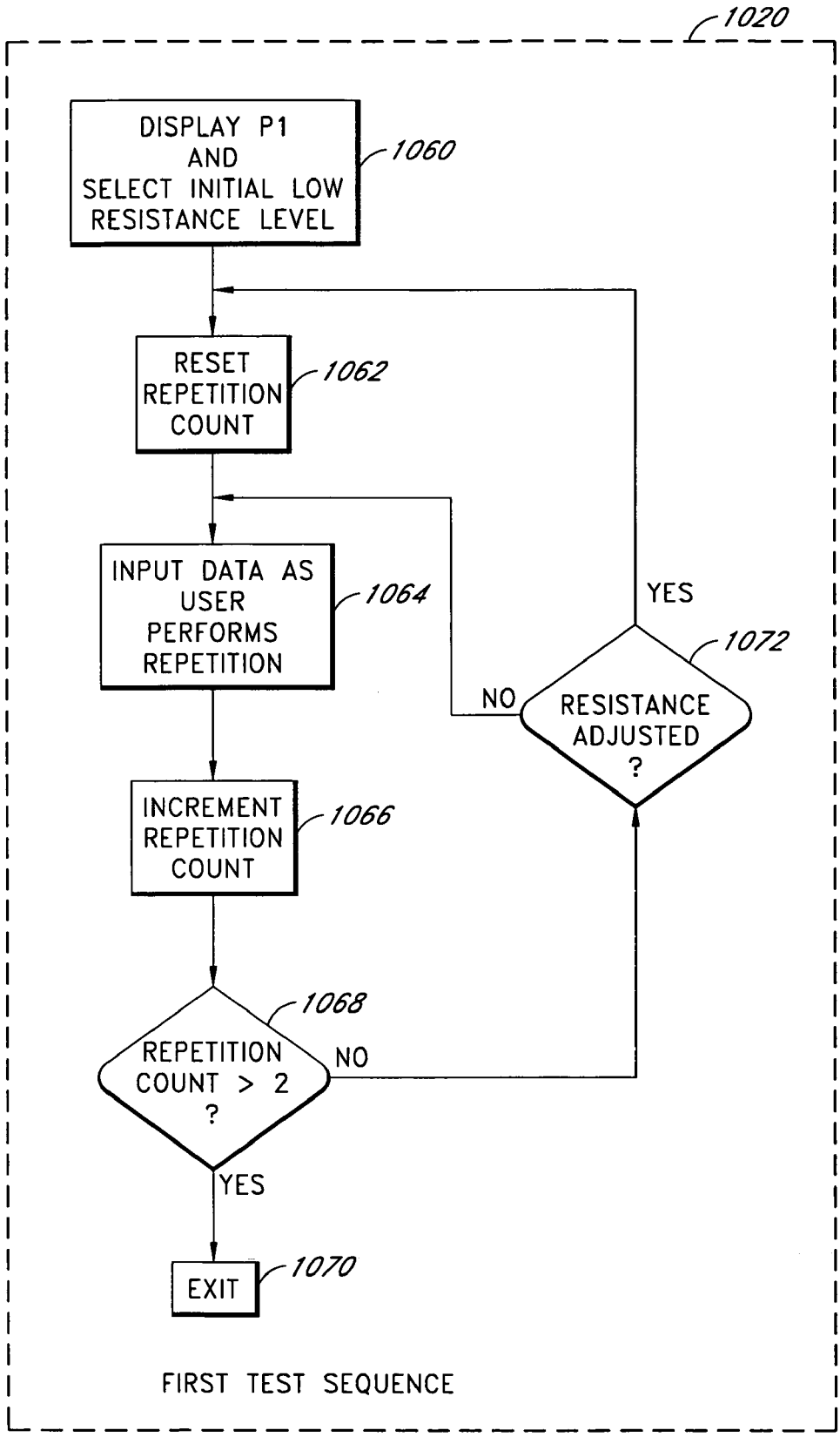
FIG. 9 illustrates a flow chart of the first test sequence in the test mode of FIG. 7 in accordance with a preferred embodiment.

As shown in FIG. 9, in the first test sequence 1060, the control system 200 first performs the actions in block 1060. In particular, the control system 200 displays the characters P1 in the test mode indicator 124 and waits until the user selects an initial resistance for the first test sequence. The user is instructed to select a very low resistance for the first test sequence in order to achieve a maximum velocity. For example, the resistance is advantageously selected to be a sufficiently low value that the resistance appears to be almost negligible to the user. This initial resistance value may be different for users at various levels of fitness.

After the user selects the initial resistance, the control system 200 resets a repetition count to zero in an action block 1062. The control system 200 sends commands to the display unit 110 to cause the display unit 110 to display the character 0 in the repetitions indicator 122.

In an action block 1064, the control system 200 monitors the transducers 230L, 230R, as the user pushes against the hand grips 60L and 60R to move the levers 40L and 40R against the selected resistance. In preferred embodiments, the control system 200 determines the maximum velocity achieved by the user during the repetition. Alternatively, the velocity can be determined at a particular location of the levers during the overall movement. In either case, the velocity is measured in a consistent manner so that the velocities can be used for the calculations described below. In certain implementations of the control system 200, the control system 200 also calculates the maximum power produced by the user during the repetition based on the resistance level and the maximum velocity. As discussed below, the maximum power can be displayed to encourage the user to move the levers at a greater velocity.

After the user performs the first repetition, the control system 200 increments the repetition count in the repetitions indicator 122 from 0 to 1 in an action block 1066. Then in a decision block 1068, the control system 200 determines whether the repetition count is equal to 1 or 2. If the repetition count is not 1 or 2 (e.g., the repetition count is 3), the control system 200 saves the maximum velocity achieved and the resistance level at which the maximum velocity was achieved and exits the first test sequence via an exit block 1070.

If the repetition count evaluated in the decision block 1068 is 1 or 2, the control system 200 proceeds to a decision block 1072 and waits until the user adjusts the resistance level or moves the handgrips to initiate the second repetition. As discussed above, the maximum power achieved during a repetition is advantageously calculated in certain embodiments and displayed to the user to enable the user to adjust the resistance level to a different value in order to endeavor to increase the maximum power produced during the first test sequence. For example, the user may want to increase the resistance if the user thinks he or she may be able to achieve approximately the same maximum speed at a higher resistance and thus increase the maximum power achieved. On the other hand, the user may reduce the resistance if the user thinks he or she may be able to increase a higher maximum speed at a lower resistance. If the user changes the resistance level before moving the handles, the control system 200 exits the decision block 1072 and returns to the action block 1062 where the control system 200 resets the repetition count to zero before entering the action block 1064 to monitor the velocity. If the user does not change the resistance level, the control system 200 returns directly to the action block 1064 without resetting the repetition count.

From the foregoing, it can be seen that the user is provided the opportunity to adjust the resistance level after either the first repetition or the second repetition. If the user adjusts the resistance level after either the first repetition or the second repetition, the repetition count is reset to zero so that the user must perform three repetitions at the same resistance level before the control system 200 exits the first test sequence 1020 and proceeds to the second test sequence 1030 described below.

As discussed above, in certain embodiments, the maximum power achieved in a repetition is advantageously calculated from the maximum velocity and the resistance level. The current power indicator 126 advantageously displays the power generated in the current repetition, and the peak power indicator 128 displays the maximum power generated in the three repetitions. For example, the peak power indicator 128 is updated if the maximum power generated during the second repetition exceeds the maximum power generated during the first repetition. Similarly, the peak power indicator 128 is updated if the maximum power generated during the third repetition exceeds the previously recorded peak power from the first repetition and the second repetition. In such embodiments, the user is instructed to attempt to exceed the previously recorded peak power on each of the second and the third repetitions. Thus, for example, if the power achieved during the second repetition does not match or exceed the power achieved during the first repetition, the user may want to decrease the resistance to achieve a higher velocity or may want to increase the resistance if the user thinks the same velocity can be achieved at a higher resistance.

In the preferred embodiment described herein, the recorded maximum velocity is reset if the user changes the resistance level after the first repetition or the second repetition so that when the control system 200 exits the first test sequence 1020, the maximum velocity and the resistance level at which the user performed three repetitions are saved to be used to determine the optimum training resistance level, as described below.

Figure 10:
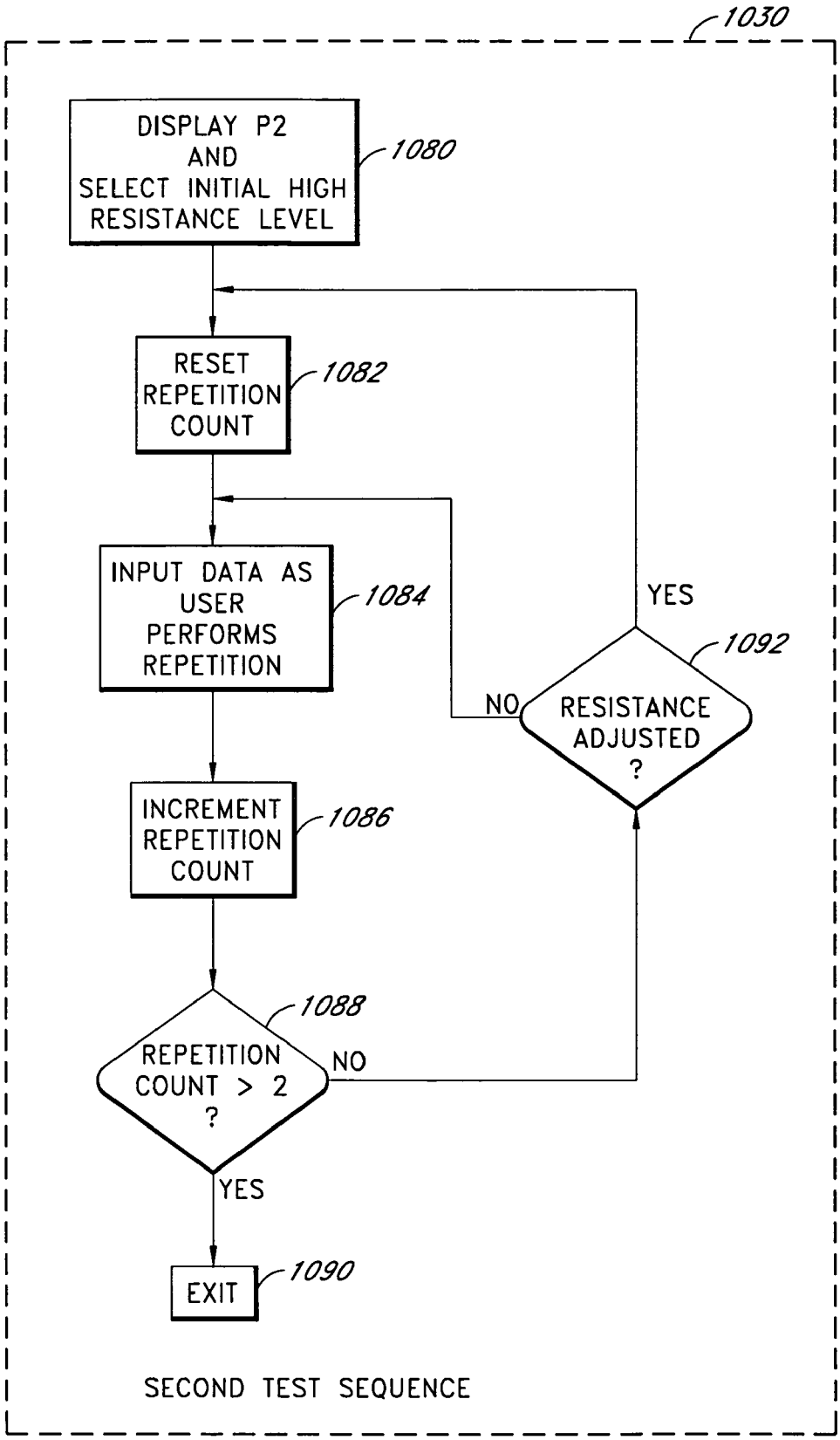
FIG. 10 illustrates a flow chart of the second test sequence in the test mode of FIG. 7 in accordance with a preferred embodiment.

As illustrated in FIG. 10, in the second test sequence 1030, the control system 200 performs actions similar to the actions performed in the first test sequence. In particular, in an action block 1060, the control system 200 displays the characters P2 in the test mode indicator 124 and waits until the user has adjusted the resistance value to an initial value. The value is selected to be just below the maximum resistance for the user of the particular apparatus 10. The maximum value may be known from previous workouts, or it may be determined by other evaluation systems, such as, for example, the system described in Applicant's copending U.S. patent application Ser. No. 10/694,198, filed on Oct. 27, 2003, which is incorporated by reference herein. In one example, the user is instructed to enter a resistance value at approximately 80% of the user's maximum value.

After selecting the initial resistance level, the control system 200 resets the repetition count to zero in a block 1082 and then advances to a block 1084 to monitor the movement of the levers 40L and 40R and gather the velocity data, as discussed above. After a repetition is completed, the control system 200 increments the repetition count in an action block 1086. Then, in a decision block 1088, the control system 200 determines whether the repetition count is 1 or 2. If the repetition count is 3 or more, the control system 200 exits the second test sequence via an exit block 1090.

If the repetition count is 1 or 2, the user is again provided the opportunity to change the resistance value as represented by a decision block 1090. If the user changes the resistance value before moving the hand grips, the control system 200 returns to the action block 1082 and resets the repetition count to zero. If the user moves the hand grips without changing the resistance level, the control system 200 returns to the action block 1084 without resetting the repetition count.

In accordance with the foregoing actions, the control system 200 enables the user to try one or two repetitions at various resistance levels so that the user can endeavor to identify the resistance level that provides the combination of resistance and velocity that produces the greatest power. As long as the user does not perform a third repetition without changing the resistance level, the control system 200 does not exit the second test sequence 1030. When the user performs three repetitions in a row without changing the resistance level, the control system 200 saves the resistance level and the maximum velocity from the three repetitions and then exits the second test sequence 1030 via the exit block 1090 and proceeds to the action block 1040 shown in FIG. 11.

Figure 11:
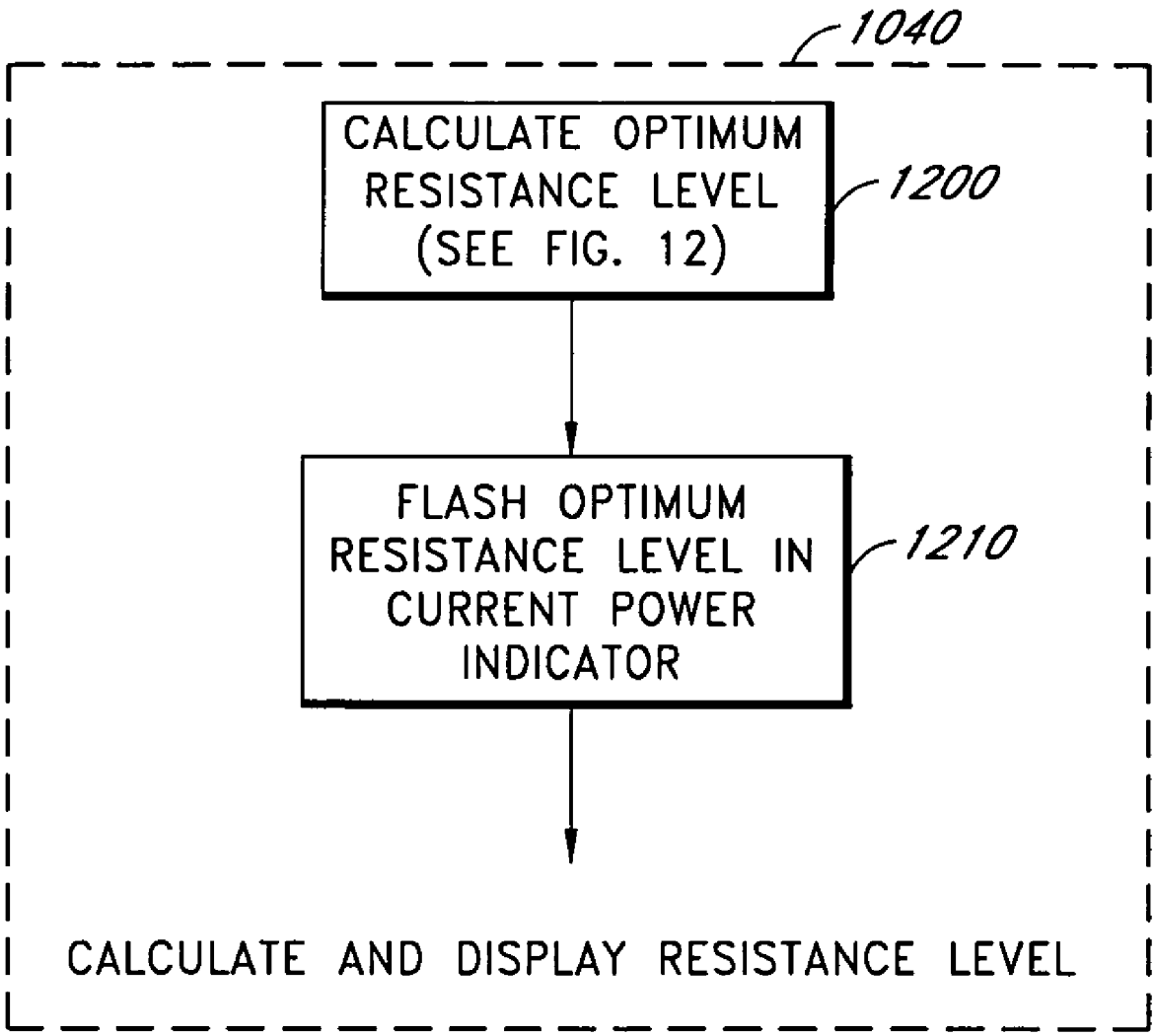
FIG. 11 illustrates a flow chart of a procedure for determining an optimum resistance level to be used when exercising to increase a user's power.

As illustrated in FIG. 11, in the action block 1040, the control system 200 calculates an optimum resistance level in an action block 1200. In particular, the optimum resistance level is calculated in the block 1200 in accordance with the procedure graphically illustrated in FIG. 12. In particular, FIG. 12 illustrates the steps for determining the overall maximum power for a user and for determining the optimum resistance level to use to achieve the overall maximum power.

Applicant has discovered that the relationship between velocity and resistance is generally linear over a wide range of resistance levels from low resistance levels to high resistance levels. The magnitudes of the "low resistance levels" and the "high resistance levels" differ in accordance with the type of exercise equipment being used and in accordance with the fitness of a user. For example, the range of resistance levels in a leg press machine will be substantially larger than the range of resistance values for the chest press apparatus 10 described herein. For the purposes of the following discussion, a range in resistance levels from 10 pounds to approximately 190 pounds is assumed for a user being tested in accordance with the above-described method. The resistance levels shown in FIG. 12 are the combined resistances for the two levers 40L, 40R being moved at the same time by both arms of a user.

Figure 12:
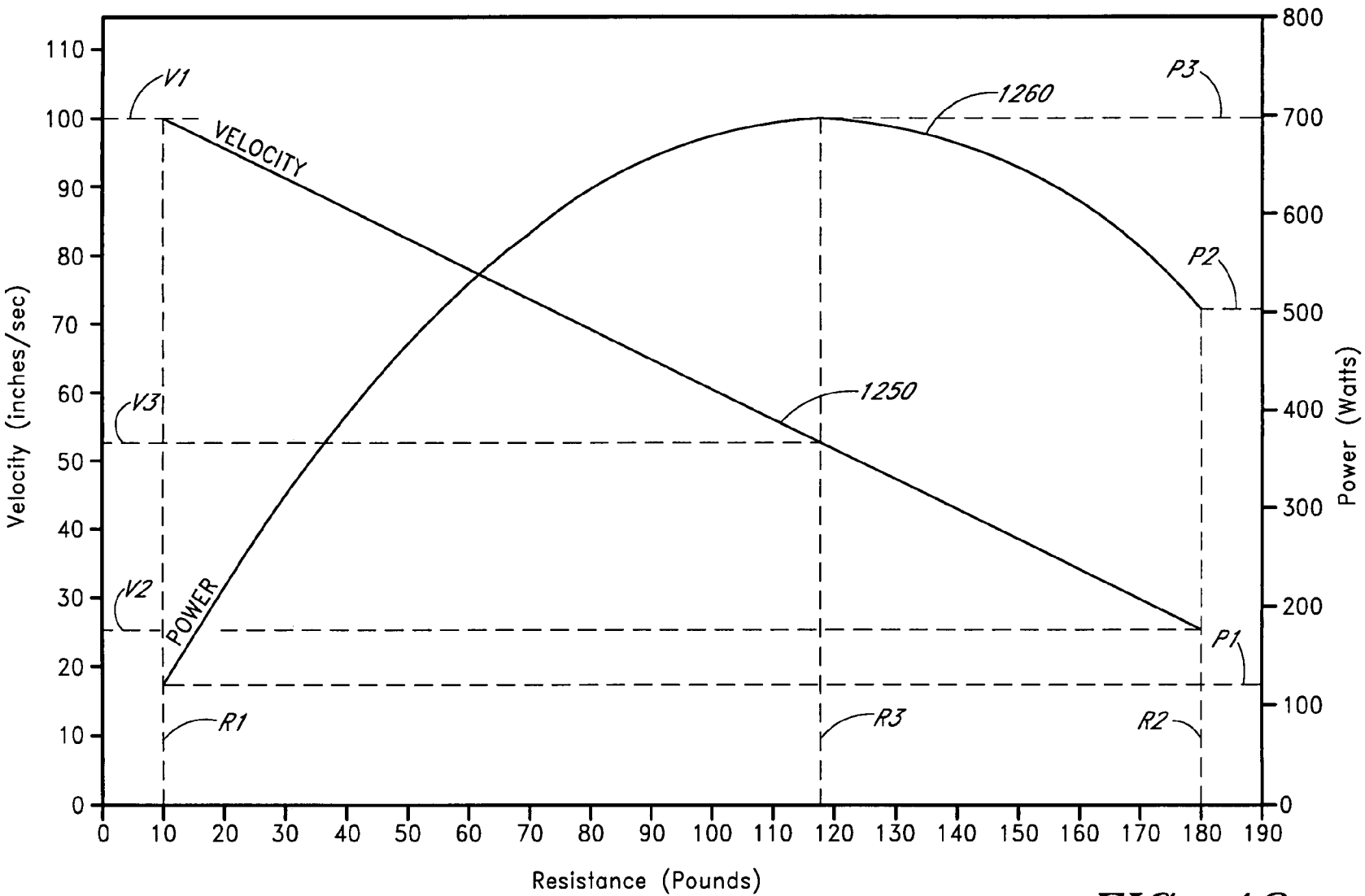
FIG. 12 illustrates a graphical representation of the procedure in FIG. 11 for determining the optimum resistance level based on the relationship between resistance level, velocity and power.

In FIG. 12, the data gathered in the block 1064 during the first test sequence (FIG. 9) and the data gathered in the block 1084 during the second test sequence (FIG. 10) are used to generate a graph of power versus the resistance level. In the illustrated example, during the first test sequence (FIG. 9), a user being tested is able to move the levers 40L, 40R (e.g., the engagement assembly) against a first resistance level (R1) of 10 pounds at a first maximum velocity (V1) of approximately 100 inches/second. During the second test sequence (FIG. 10), the same user is able to move the engagement assembly against a second resistance level (R2) of 180 pounds at a second maximum velocity (V2) of approximately 25 inches per second.

For the purposes of determining the resistance level at which the user generates the maximum velocity, a linear relationship between the resistance levels and the maximum velocities is assumed, as represented by the straight line 1250 drawn between the two end points (R1, V1; and R2, V2) in FIG. 12. It should be understood that the relationship between the velocity and the resistance level will vary from user to user. Thus, the end points of the straight line 1250 and the slope of the straight line 1250 will vary from user to user.

The linear relationship between the maximum velocity and the resistance level allows the maximum velocity to be determined for the resistance levels between the two end points. The maximum velocity at each resistance level is multiplied by the resistance level to obtain the power (e.g., power=force times velocity). The power is represented by the curved graph 1260 in FIG. 12 extending from a first maximum power (P1) at the first resistance level (R1) to a second maximum power (P2) at the second resistance level (R2). The overall maximum power generated by the user being tested is determined as the maximum point (P3) on the power graph 1260 (e.g., approximately 698 watts at an optimum resistance level (R3) of approximately 118 pounds and a corresponding velocity (V3) of approximately 52 inches/sec. It can be seen from the graph that training at a greater resistance level than the optimum resistance level (R3) further reduces the maximum velocity such that the generated power is reduced below the overall maximum power (P3). Training at a lower resistance level to increase the velocity also reduces the generated power.

In certain embodiments, the graphing steps described above are performed to generate a visual indication of the foregoing information. In preferred embodiments, the graphing step is not performed. Rather, the control system 200 determines the maximum power from the calculated values in a conventional manner. In particular, the straight line 1250 can be extended mathematically to the right in FIG. 12 to intersect the horizontal axis at zero velocity. The resistance level at the intersection is the maximum resistance level. Ideally, because of the approximately linear relationship between the velocity and the resistance level, the optimum resistance level at which maximum power is achieved for a particular user is approximately equal to 50 percent of the maximum resistance level.

After calculating the optimum resistance level in the block 1200, the control system 200 advances to an action block 1210, wherein the control system 200 sends commands to the display unit 110 to cause the current power indicator 126 to flash with the calculated optimum resistance value. If the user inserted the user's data key 162 in the data port recess 160 prior to initiating the test mode, the optimum resistance level is stored in the data key 162 in association with the particular apparatus 10. Thereafter, when the user returns to the particular apparatus 10 and inserts the data key 162, the control system 200 flashes the stored optimum value for the resistance level in the current power indicator 126, as discussed above, so that the user can readily enter the optimum resistance value into the resistance indicator 120 before beginning a workout session.

The control system 200 also utilizes the resistance indicator 120 to provide error messages to the user. For example, if the user does not select the low resistance for the first test sequence and the maximum resistance for the second test sequence at appropriate levels such that the difference between the resistance levels is too small, the control system 200 causes the display unit 110 to flash the characters Er1, Er2, Er3 or Er4 in the resistance indicator 120.

If a user decides to abandon the power test without completing one or both test sequences, the user may exit the test mode by removing the data key 162 if the user inserted the data key 162 in the data port recess 160 prior to starting the test mode. If the user started the test mode without a data key 162 in the data port recess 160, the user may exit the test mode by pressing both actuator buttons 66L and 66R at the same time for the apparatus 10 or corresponding actuator switches for other exercise devices.

As discussed above, if a user inserts a data key 162 into the data port recess 160 at the beginning of a power test, the optimum resistance level and maximum power are saved. The user can retrieve the saved data during a subsequent workout session. The user may also perform the above-described power test on a periodic basis to determine whether the training at the optimum resistance has had the desired effect of increasing the user's power generation. Thus, for example, a subsequent test may advantageously show that the user's maximum power generation has increased. In some cases, the maximum power may occur at a different optimum resistance level. By displaying the revised optimum resistance level to the user, the user is able to change the resistance level in order to continue training for maximum power generation.

As discussed above, each control system 200 is programmed to work with a specific model of exercise machine so that the measurement of velocity and the calculations of power correspond to the configuration of a particular exercise machine. In addition, the control system 200 is programmable with the approximate elevation of the location where a particular machine is installed so that the approximate barometric pressure can be determined for use in determining the resistance provided by the pneumatic cylinders so that the pressure transducer 224 (FIGS. 5 and 6) is not needed to determine barometric pressure in certain embodiments. Preferably, the approximate elevation of the location is programmed during initial installation and during system maintenance as needed via setting devices located on a circuit board for the control system. Generally, the elevation setting and other system settings are not accessible by the user during normal operations. The control system 200 also records the current resting position of the resistance cylinders as the zero point of the cylinders for use in calculations during the operation of the exercise apparatus 10. In alternative embodiments, the zero point of the cylinders is set using the external computer system 250.

It should be understood that the foregoing description of a chest press apparatus is only one example of a measurement apparatus that can implement the system and method in accordance with aspects of the present invention. For example, one skilled in the art will appreciate that the foregoing features can be advantageously incorporated into a leg conditioning apparatus to enable the power of the legs to be measured to determine the velocity and resistance level where a subject develops the maximum power. After determining the velocity and resistance level for maximum power, a suitable conditioning program can be developed to increase the velocity and the strength to achieve a desired result. One skilled in the art will also appreciate that the methods described herein can advantageously be implemented on other exercise and testing devices having the capability of measuring velocities achieved by a user at adjustable resistance levels.

Although described above with respect to athletic ability, it should be understood that the apparatus and method in accordance with aspects of the embodiments of the present invention can be advantageously used in other environments. For example, one problem encountered by a significant portion of an aging population is loss of strength and mobility. Failure to develop and maintain an adequate physical condition while younger becomes a far greater problem as the muscles deteriorate and weaken. It has been shown that strengthening exercises are beneficial to the overall health of an aging individual. However, as discussed above, measurement of strength alone is not sufficient in most cases to properly determine a person's physical ability. The above-described apparatus and method can be advantageously used to determine the resistance level and velocity where a person has the greatest power. A conditioning program can then be developed to improve the person's overall power rather than simply increasing strength or increasing speed. More particularly, by starting where the person has the most power, the conditioning program can start at a force and velocity where the person is most likely to be able to complete an exercise routine such that the person will also develop the confidence required to continue with the conditioning program. Other low-inertia exercise apparatuses that can be automatically controlled to selectively increment the resistance between each successive exercise stroke can also be advantageously used. For example, apparatuses using electromagnetic resistance devices, apparatuses using hydraulic resistance devices, or the like, may be used.

The invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes which come within the meaning and range of equivalency of the claims are to be embraced within that scope.

What is claimed is:

1. A method for selecting a resistance level to use to train a muscle group for maximum power generation on an exercise apparatus having a controller, an engagement assembly movable against a resistance element by the muscle group of a user and having a monitoring system that measures a velocity of movement of the engagement assembly, the method comprising:

providing a controller;

adjusting the resistance element via the controller to a first resistance level (R1), the first resistance level (R1) selected to be a low level;

monitoring the movement of the engagement assembly against the first resistance level (R1) to determine a first velocity (V1) of movement of the engagement assembly;

adjusting the resistance element via the controller to a second resistance level (R2) different from the first resistance level (R1);

monitoring the movement of the engagement assembly against the second resistance level (R2) to determine a second velocity (V2) of movement of the engagement assembly;

using at least the equation $P=R\times V$ to determine a relationship between the resistance level and the velocity of movement of the engagement assembly based on the first and second resistance levels (R1, R2), the first and second velocities of movement (V1, V2), and a predetermined relationship between resistance levels and velocities, the determined relationship defining a plurality of power values (P1, P2, P3) including an overall maximum power (P3) generated by the user; and using the determined relationship to determine a resistance level (R3) that corresponds to the overall maximum power (P3) as the resistance level to use for training the muscle group for maximum power.

2. The method as defined in claim 1, wherein monitoring the movement of the engagement assembly against the first resistance level (R1) comprises monitoring a plurality of repetitions of the movement of the engagement assembly and selecting as the first velocity (V1) a maximum velocity achieved in the plurality of movements.

3. The method as defined in claim 2, wherein the monitoring system monitors a maximum number of repetitions before selecting the first velocity (V1), and wherein adjusting the first resistance level (R1) of the resistance element to an adjusted first resistance level resets the repetitions such that the first velocity (V1) is selected only after the maximum number of repetitions are performed at the adjusted first resistance level.

4. The method as defined in claim 2, wherein the monitoring system displays a number representing the power generated during each repetition to provide the user with an incentive to increase the power on a subsequent repetition.

5. The method as defined in claim 1, wherein monitoring the movement of the engagement assembly against the second resistance level (R2) comprises monitoring a plurality of repetitions of the movement of the engagement assembly and selecting as the second velocity (V2) a maximum velocity achieved in the plurality of movements.

6. The method as defined in claim 5, wherein the monitoring system monitors a maximum number of repetitions before selecting the second velocity (V2), and wherein adjusting the second resistance level (R2) of the resistance element to an adjusted second resistance level resets the repetitions such that the second velocity (V2) is selected only after the maximum number of repetitions are performed at the adjusted second resistance level.

7. The method as defined in claim 5, wherein the monitoring system displays a number representing the power generated during each repetition at the second resistance level (R2) to provide the user with an incentive to increase the power on a subsequent repetition.

8. The method as defined in claim 1 further comprising receiving a signal at the controller that is indicative of a position of an actuator button.

9. The method as defined in claim 1 further comprising receiving a signal at the controller that is indicative of a position of a foot pedal.

10. The method as defined in claim 1, wherein the determined resistance level (R3) is different than the first and second resistance levels (R1, R2).

11. The method as defined in claim 1, wherein the determined resistance level (R3) is then displayed.

12. The method as defined in claim 1, wherein the predetermined relationship is a linear relationship.

13. The method as defined in claim 12, wherein the linear relationship between resistance levels (R) and velocities (V) is $V=((V2-V1)/(R2-R1))\times R+V1-((V2-V1)/(R2-R1))\times R1$.

* * * * *